US005166464A

United States Patent [19]

Sakata et al.

[11] Patent Number: 5,166,464

[45] Date of Patent: Nov. 24, 1992

[54] ELECTRONIC MUSICAL INSTRUMENT HAVING A REVERBERATION

[75] Inventors: Goro Sakata, Tokyo; Akio Iba, Tokorozawa, both of Japan

[73] Assignee: Casio Computer Co., Ltd., Tokyo, Japan

[21] Appl. No.: 777,674

[22] Filed: Oct. 15, 1991

[30] Foreign Application Friority Data

| | | | |
|---|---|---|---|
| Nov. 28, 1990 | [JP] | Japan | 327701 |
| Nov. 28, 1990 | [JP] | Japan | 327704 |
| Mar. 1, 1991 | [JP] | Japan | 35991 |

[51] Int. Cl.[5] ..... G10H 1/04; G10H 1/053; G10H 1/46

[52] U.S. Cl. ..... 84/662; 84/665; 84/DIG. 26; 381/63

[58] Field of Search ..... 84/630, 633, 662-665, 84/707, 711, 737-741, DIG. 26; 381/63

[56] References Cited

U.S. PATENT DOCUMENTS

| | | | |
|---|---|---|---|
| 3,978,421 | 8/1976 | Walker | 84/705 X |
| 4,649,786 | 5/1987 | Niinomi et al. | 84/707 X |
| 4,679,480 | 7/1987 | Suzuki . | |
| 4,706,537 | 11/1987 | Oguri . | |
| 4,738,179 | 4/1988 | Hideo . | |
| 4,909,119 | 3/1990 | Morokuma . | |
| 4,909,121 | 3/1990 | Usa et al. . | |

FOREIGN PATENT DOCUMENTS

| | | |
|---|---|---|
| 60-68387 | 4/1985 | Japan . |
| 60-91395 | 5/1985 | Japan . |
| 61-172192 | 8/1986 | Japan . |

*Primary Examiner*—Stanley J. Witkowski
*Attorney, Agent, or Firm*—Frishauf, Holtz, Goodman & Woodward

[57] ABSTRACT

Either the frequency of phase of an original musical sound signal is modulated, the musical sound signal is weighted, a reverberation effect is added thereto and the thus modified signal is added with the original musical sound signal.

16 Claims, 18 Drawing Sheets

PROGRAM MEMORY
CONTROL CIRCUIT
ADDRESS OFFSET MEMORY
DELAY MEMORY
COEFFICIENT MEMORY
WORK MEMORY
MULTIPLIER
ADDER AND SUBTRACTER
CLIPPER
CPU
SC
IN
OUT
ADDRESS
E
EO
EA
EI
ER
ADD
LF
AR
TR
MR
MO
MI
AO
AI
SR
OR
P
W
PI
X
Y
A
B
C
D
201
202
203
204
205
206
207
208
209
210
211
212
213
214
215
216
217
218
219
220
221
222
223
224
225
226
227
228
229
230
231
232
106

DELAY MEMORY 401
VWA
VRA2
VRA1
E
402
404
VL
403
VO
VIBRATO CALCULATING UNIT

TRIANGULAR WAVE GENERATOR UNIT 404
RAT
408
SAW
407
0.5
TRI
409
LPF UNIT 405
G
410
411
1-G
413
SIN
412
VIBRATO ADDRESS CALCULATING UNIT 406
FMD
414
SC
415
VR
VR+1
417
416
VRA1
VRA2
VL
VIBRATO ADDRESS GENERATING UNIT

FIG.17

| ADDRESS | NAME | CONTENT |
|---|---|---|
| 00 | RAT | LFO RATE CORRESPONDING VALUE |
| 01 | G | LFO FILTER COEFFICIENT |
| 02 | 1-G | LFO FILTER COEFFICIENT |
| 03 | FMD | VIBRATO DEPTH COEFFICIENT |
| 04 | 0.5 | CONSTANT |
| 05 | RVT | REVERBERATION TIME |
| 06 | RVD | REVERBERATION DEPTH |

FIG.18

| ADDRESS | NAME | CONTENT |
|---|---|---|
| 00 | 0.0 | CONSTANT |
| 01 | 1.0 | CONSTANT |
| 02 | R | RIGHT CHANNEL DIRECT SOUND |
| 03 | L | LEFT CHANNEL DIRECT SOUND |
| 04 | E | PEDAL EFFECT FEED SOUND |
| 05 | SAW | SAWTOOTH WAVE LFO OUTPUT |
| 06 | TRI | TRIANGULAR WAVE LFO OUTPUT |
| 07 | SIN | SINE WAVE LFO OUTPUT |
| 08 | VL | INTERPOLATION LFO DATA |
| 09 | VO | VIBRATO OUTPUT |
| 0A | AO1 | ALLPASSFILTER 1 OUTPUT |
| 0B | AO2 | ALLPASSFILTER 2 OUTPUT |
| 0C | CRO 1 | COMBFILTER 1 RIGHT CHANNEL OUTPUT |
| 0D | CRO 2 | COMBFILTER 2 RIGHT CHANNEL OUTPUT |
| 0E | CRO 3 | COMBFILTER 3 RIGHT CHANNEL OUTPUT |
| 0F | CRO 4 | COMBFILTER 4 RIGHT CHANNEL OUTPUT |
| 10 | CRO 5 | COMBFILTER 5 RIGHT CHANNEL OUTPUT |
| 11 | CRO 6 | COMBFILTER 6 RIGHT CHANNEL OUTPUT |
| 12 | CRO 7 | COMBFILTER 7 RIGHT CHANNEL OUTPUT |
| 13 | CRO 8 | COMBFILTER 8 RIGHT CHANNEL OUTPUT |
| 14 | CLO 1 | COMBFILTER 1 LEFT CHANNEL OUTPUT |
| 15 | CLO 2 | COMBFILTER 2 LEFT CHANNEL OUTPUT |
| 17 | CLO 3 | COMBFILTER 3 LEFT CHANNEL OUTPUT |
| 18 | CLO 4 | COMBFILTER 4 LEFT CHANNEL OUTPUT |
| 19 | CLO 5 | COMBFILTER 5 LEFT CHANNEL OUTPUT |
| 1A | CLO 6 | COMBFILTER 6 LEFT CHANNEL OUTPUT |
| 1B | CLO 7 | COMBFILTER 7 LEFT CHANNEL OUTPUT |
| 1C | CLO 8 | COMBFILTER 8 LEFT CHANNEL OUTPUT |
| 1D | ROT | REVERBERATION RIGHT CHANNEL OUTPUT |
| 1E | LOT | REVERBERATION LEFT CHANNEL OUTPUT |
| 1F | ROUT | RIGHT CHANNEL MUSICAL SOUND OUTPUT |
| 20 | LOUT | LEFT CHANNEL MUSICAL SOUND OUTPUT |

FIG. 19

| ADDRESS | NAME | CONTENT |
|---|---|---|
| 00 | VW | VIBRATO WRITE ADDRESS OFFSET |
| 01 | VR | VIBRATO READ ADDRESS OFFSET |
| 02 | VR+1 | VIBRATO READ ADDRESS OFFSET |
| 03 | AW1 | ALLPASS#1 WRITE ADDRESS OFFSET |
| 04 | AR1 | ALLPASS#1 READ ADDRESS OFFSET |
| 05 | AW2 | ALLPASS#2 WRITE ADDRESS OFFSET |
| 06 | AR2 | ALLPASS#2 READ ADDRESS OFFSET |
| 07 | CW1 | COMB#1 WRITE ADDRESS OFFSET |
| 08 | CRR1 | COMB#1 RIGHT CANNEL READ ADDRESS OFFSET |
| 09 | CLR1 | COMB#1 LEFT CANNEL READ ADDRESS OFFSET |
| 0A | CW2 | COMB#2 WRITE ADDRESS OFFSET |
| 0B | CRR2 | COMB#2 RIGHT CANNEL READ ADDRESS OFFSET |
| 0C | CLR2 | COMB#2 LEFT CANNEL READ ADDRESS OFFSET |
| 0D | CW3 | COMB#3 WRITE ADDRESS OFFSET |
| 0E | CRR3 | COMB#3 RIGHT CANNEL READ ADDRESS OFFSET |
| 0F | CLR3 | COMB#3 LEFT CANNEL READ ADDRESS OFFSET |
| 10 | CW4 | COMB#4 WRITE ADDRESS OFFSET |
| 11 | CRR4 | COMB#4 RIGHT CANNEL READ ADDRESS OFFSET |
| 12 | CLR4 | COMB#4 LEFT CANNEL READ ADDRESS OFFSET |
| 13 | CW5 | COMB#5 WRITE ADDRESS OFFSET |
| 14 | CRR5 | COMB#5 RIGHT CANNEL READ ADDRESS OFFSET |
| 15 | CLR5 | COMB#5 LEFT CANNEL READ ADDRESS OFFSET |
| 16 | CW6 | COMB#6 WRITE ADDRESS OFFSET |
| 17 | CRR6 | COMB#6 RIGHT CANNEL READ ADDRESS OFFSET |
| 18 | CLR6 | COMB#6 LEFT CANNEL READ ADDRESS OFFSET |
| 19 | CW7 | COMB#7 WRITE ADDRESS OFFSET |
| 1A | CRR7 | COMB#7 RIGHT CANNEL READ ADDRESS OFFSET |
| 1B | CLR7 | COMB#7 LEFT CANNEL READ ADDRESS OFFSET |
| 1C | CW8 | COMB#8 WRITE ADDRESS OFFSET |
| 1D | CRR8 | COMB#8 RIGHT CANNEL READ ADDRESS OFFSET |
| 1E | CLR8 | COMB#8 LEFT CANNEL READ ADDRESS OFFSET |

ELECTRONIC MUSICAL INSTRUMENT HAVING A REVERBERATION

BACKGROUND OF THE INVENTION

1. Field of the Invention

The present invention generally relates to electronic musical instruments and, more particularly, to an electronic musical instrument such as electronic pianos or the like in which a resonance sound is generated by operating devices such as keyboard, pedal and so on.

2. Description of the Related Art

A pedal effect addition has been widely performed in electronic pianos in order to add similar effects as those of a sustain pedal of an acoustic piano. According to a known pedal effect adding system, when the pedal is stepped, a sound is generated so as to have the same musical sound envelope as that brought by continuously pushing the key even after the key is released. Another proposal has also been made, in which the envelope characteristic is switched in response to the on and/or off state of the pedal. Further, in such proposal it is also known that the envelope characteristic is switched in response to the continuous displacement of the stepped amount of the pedal.

Furthermore, considering the function of the pedal in the acoustic piano, it is to be noted that the important constituent of a particular sound generated when the pianist steps on the pedal is not only formed of the sound brought by the change of envelope characteristic but also of a resonance sound generated by resonating other strings by the vibration of a string of a pushed key when damper of all strings are released. From this standpoint, such a technique is proposed that a reverberation effect is added to musical sound generated in response to the operation of the pedal so as to generate the above resonance sound in the electronic musical instrument in a false fashion.

According to the above technology, the effect of the resonance sound can be added to the musical sound with ease.

In the acoustic piano, the fluctuation or undulation are generated in the resonance sound due to the fact that the string is tuned on the basis of a characteristic called a tuning curve and due to a shift of overtone frequency caused by the size of the string itself.

However, there is then the disadvantage that fluctuation undulation effects of the resonance sound cannot be achieved without difficulty only by the addition of reverberation effect like the above example of the prior art.

Further, the sound volume of the resonance sound of the above-mentioned acoustic piano is different depending on the key note of the pushed key because the sound volume of the resonance sound depends upon the number of other strings having overtone component close to a fundamental tone or overtone of the string of the pushed key. It is considered that, if the key note of the pushed key is high, then the sound volume of the resonance sound becomes large.

However, there is then the disadvantage that resonance sounds whose sound volumes are changed in response to the key notes of the pushed keys cannot be generated only by the addition of the reverberation effect like the above example of the prior art.

SUMMARY OF THE INVENTION

Accordingly, it is an object of the present invention to provide an improved electronic musical instrument housing an effect adding device in which the aforementioned shortcomings and disadvantages encountered with the prior art can be eliminated.

More specifically, it is an object of the present invention to provide an electronic musical instrument housing an effect adding device which can generate fluctuation and undulation of a resonance sound.

Another object of the present invention is to provide an electronic musical instrument housing an effect adding device in which resonance sounds of different volumes can be generated in response to key notes of the pushed keys.

According to a first aspect of the present invention, an electronic musical instrument housing an effect adding device is comprised of a sound source for generating a musical sound signal in response to a musical performance information, a modulator for modulating either a frequency or phase of an original musical sound signal generated from the sound source, a reverberation sound generating unit for adding a reverberation effect to the musical sound signal modulated by the modulator to generate a reverberation sound, an operating device for generating an operation information for controlling a sound volume of the reverberation sound in response to the operation done by a player, a reverberation sound volume control unit for controlling a sound volume of the reverberation sound generated by the reverberation sound generating unit in accordance with the operation information from the operating device, and an adder for adding the reverberation sound generated by the reverberation sound generating unit to an original musical sound signal generated from the sound source to generate a musical sound output signal.

As a second aspect of the present invention, an electronic musical instrument housing a pedal effect adding device is comprised of a sound source for generating a musical sound signal in response to a musical performance information, a weighting circuit for weighting an original musical sound signal generated from the sound source in response to the musical performance information, a reverberation sound generating unit for adding a reverberation effect to the musical sound signal weighted by the weighting circuit to generate a reverberation sound, an operating device for generating an operation information for controlling a sound volume of the reverberation sound on the basis of operation done by a player, a reverberation sound volume control unit for controlling a sound volume of the reverberation sound generated by the reverberation sound generating unit in accordance with the operation information from the operating device, and an adder for adding the reverberation sound generated from the reverberation sound generating unit to the original musical sound generated from the sound source to generate a musical sound output signal.

The above and other objects, features, and advantages of the present invention will become apparent in the following detailed description of illustrative embodiments thereof to be read in conjunction with the accompanying drawings, in which like reference numerals are used to identify the same or similar parts in the several views.

BRIEF DESCRIPTION OF THE DRAWINGS

FIG. 17 is a table showing a coefficient memory map used in the present invention;

FIG. 18 is a table showing a work memory map used in the present invention;

FIG. 19 is a table showing an address offset memory map used in the present invention.

DESCRIPTION OF THE PREFERRED EMBODIMENTS

The present intention will now be described in detail with reference to the accompanying drawings.

Figure 1:
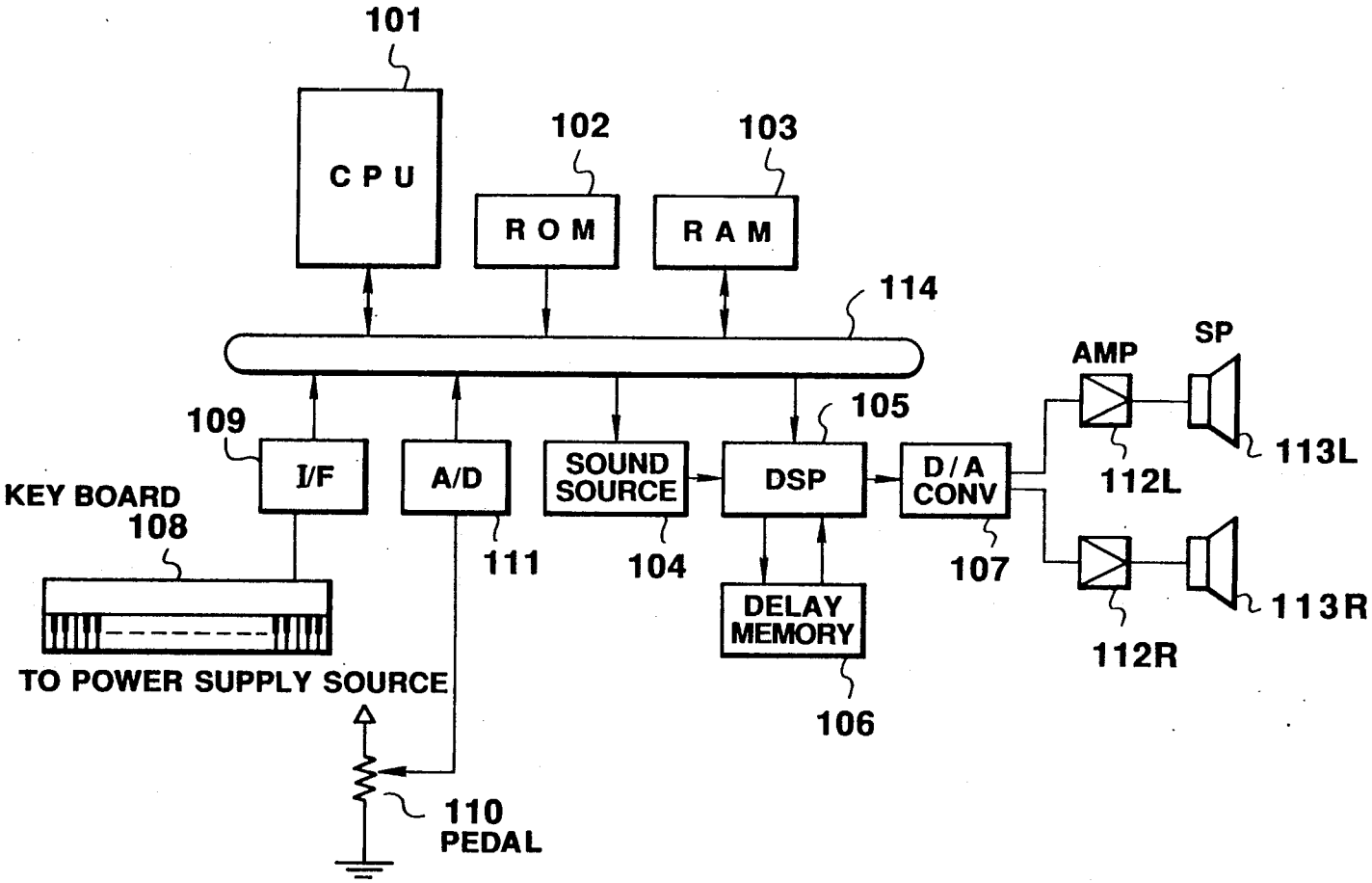
FIG. 1 is a block diagram showing an overall arrangement of an electronic musical instrument housing an effect adding device according an embodiment of the present invention.

FIG. 1 shows in block form an arrangement of the electronic musical instrument housing an effect adding device according to the embodiment of the present invention.

Referring to FIG. 1, a central processing unit (CPU) 101 executes a program stored in a read only memory (ROM) 102 connected thereto through a bus 114 by using a random access memory (RAM) 103 as a work memory to perform control operations, such as control of a sound source 104 on the basis of musical performance information input thereto from a keyboard 108 through an interface circuit (I/F) 109 and the bus 114, control of a digital signal processor (DSP) 105 on the basis of operation information of a pedal 110 input thereto through an analog-to-digital (A/D) converter 111 or the like.

A musical sound signal generated from a sound source 104 is supplied to the DSP 105. The DSP 105 utilizes a delay memory (E) 106 or the like to execute a predetermined operation program such that the digital musical sound signal data input from the sound source 104 is modulated or added with a reverberation effect by changing a read address by a desired time. The digital musical sound signal modulated and added with the reverberation effect is converted into analog musical sound signals of left and right channels by a digital-to-analog (D/A) converter 107, amplified by left channel and right channel amplifiers 112L and 112R, and then emanated from speakers 113L and 113R, respectively.

Figure 2:
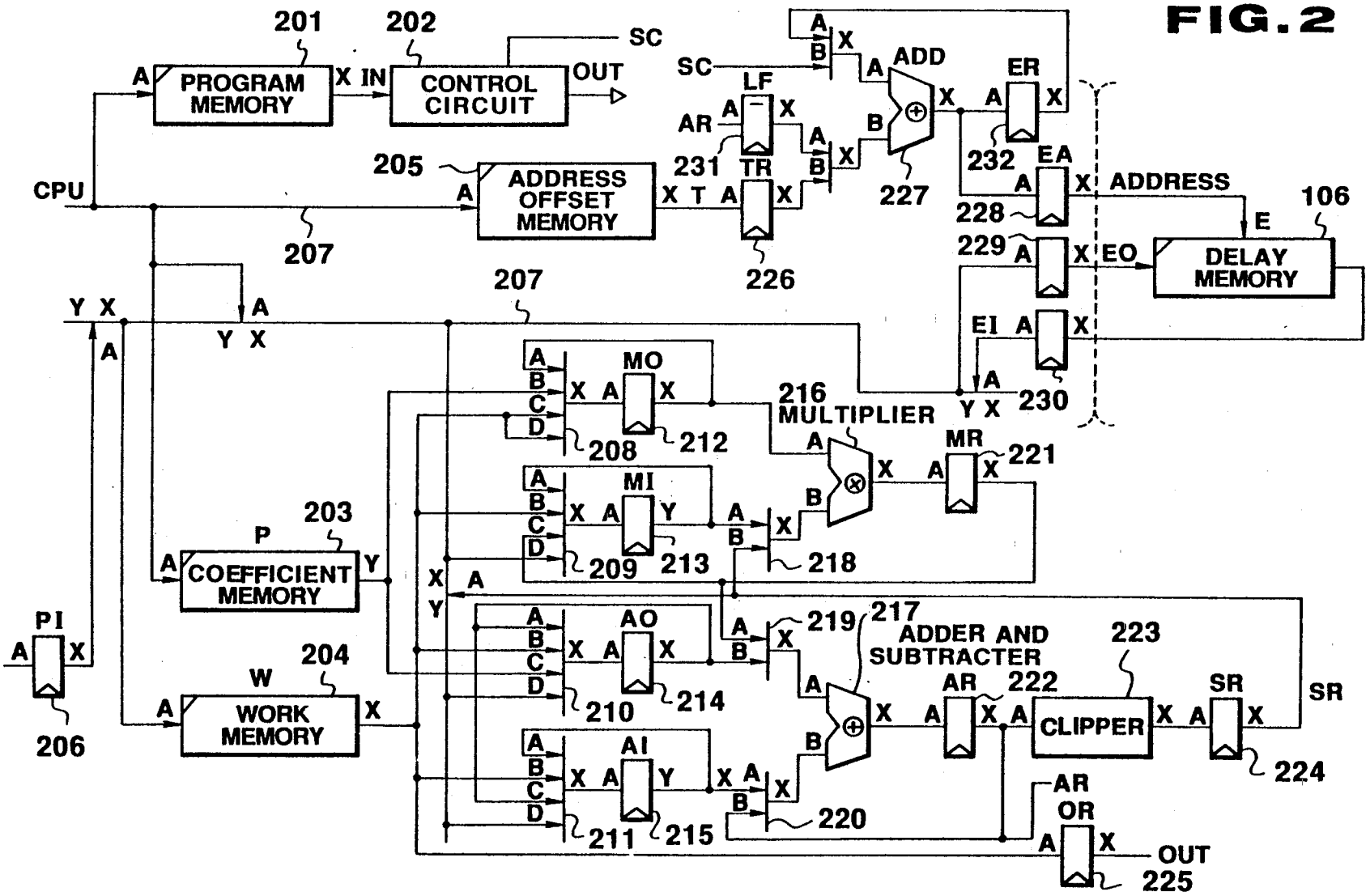
FIG. 2 is a block diagram showing an arrangement of a digital signal processor (DSP) used in the present invention.

FIG. 2 is a block diagram showing an inside arrangement of the DSP 105 shown in FIG. 1.

Referring to FIG. 2, a program memory 201 is adapted to store a predetermined micro-program and supplies a predetermined operation program to a control circuit 202 in accordance with an instruction from the CPU 101 of FIG. 1.

The control circuit 202 produces a variety of control signals used to transfer data between registers and memories, which will be described later, used for a calculation and used to open and close gates and latches and produces a count value SC which increments at every sampling timing on the basis of output contents of the program memory 201 and which executes desired signal processing operations.

A coefficient memory (P) 203 is a register which stores therein a variety of parameters for adding reverberation effect as will be described later with reference to FIG. 17. These coefficients shown in FIG. 17 are read out from the RAM 103 of in FIG. 1 and stored in the coefficient memory 203 under the control of the CPU 101.

A work memory (W) 204 is adapted to temporarily save waveform signals generated within the DSP 105 as will be described later with reference to FIG. 18.

An address offset memory (T) 205 serves as a register which stores therein address offset values of a delay memory (E) 106 (later referred to), as shown in FIG. 19 which will be referred to later. The offset values are read out from the RAM 103 shown in FIG. 1 and stored in the address offset memory 205 under the control of the CPU 101.

Output and input of the delay memory 106 are coupled in an annular fashion by means of a register (EI)

230 and a register (EO) 229, and the delay memory 106 is supplied with an address which results from adding the count value SC, which increments at every sampling timing and the offset value from the delay address offset memory 205 by an adder 227. A delay time of data written in the delay memory 106 in a certain offset value is expressed in the form of a difference between the offset delay and the lead address offset delay. The read and write of data from and to the delay memory 106 are carried out via the registers (EO) 229 and (EI) 230, which will be described later.

An input register (PI) 206 stores therein the digital input musical sound signal generated from the sound source 104 shown in FIG. 1 and supplies the same to respective portions through an internal bus 207.

Outputs of the aforementioned coefficient memory (P) 203 and the work memory (W) 204 and the output of the input register (PI) 206 are supplied to gate terminals of gates 208 to 211 together with outputs of registers which will be described later, and outputs of the gates 208 to 211 are input to registers (M0) 212, (M1) 213, (A0) 214 and (A1) 215.

The registers (M0) 212 and (M1) 213 are adapted to store therein data which are not fully calculated and which are supplied to a multiplier 216, and the registers (A0) 214 and (A1) 215 are adapted to store data which are not fully calculated and which are supplied to an adder and subtracter 217.

The output of the register (M1) 213 and an output of a register (SR) 224, which will be described later, are supplied through the gate 218 to the multiplier 216, and the output of the register (A0) 214 and an output of a register (MR) 221, which will be described later, are supplied to the adder and subtracter 217 through the gate 219. Further, the output of the register (A1) 215 and an output of a register (AR) 222, which will be described later, are supplied to the adder and subtracter 217 through a gate 220.

A multiplied result of the multiplier 216 is stored in the register (MR) 221, and the output of the register (MR) 221 is supplied to the gates 209 and 219. A calculated result of the adder and subtracter 217 is stored in the register (AR) 222, and the output of the register (AR) 222 is supplied to the gate 220. The output of the register (AR) 222 is also supplied to the register (SR) 224 through a clipper circuit 223 which is provided in order to avoid overflow. The output of the register (SR) 224 is supplied to the gate 218 and is also stored in the work memory (W) 204 via the internal bus 207 as a calculated result of a calculation processing with respect to a certain sound.

When the above calculated result is stored in the work memory (W) 204 and a series of processings are finished, then the data stored in the work memory (W) 204 is transferred to an output register (OR) 225 and supplied from the output register (OR) 225 to the D/A converter 107 shown in FIG. 1.

An output of the address offset memory (T) 205 is supplied to the register (TR) 226, the output of which is supplied to the adder 227 together with the count value SC which increments at every sampling timing. The calculated result of the adder 227 is supplied to a register (EA) 228 and the value of the register (EA) 228 is stored in the delay memory (E) 106 as an address. The digital input musical sound signal to be added with a reverberation effect is supplied through the internal bus 207 to the register (EO) 229 whose output is supplied to the delay memory (E) 106. An output delayed by a predetermined delay time and modulated on the basis of a difference between the write address and the read address in the delay memory (E) 106 is supplied from the delay memory (E) 106 to the register (EI) 230.

Then, the musical sound signal data added with the reverberation effect and stored in the register (EI) 230 is transferred through the internal bus 207, for example, to the registers (A0) 214 and (A1) 215, from which it is derived as right channel output and left channel output, respectively.

Figure 3:
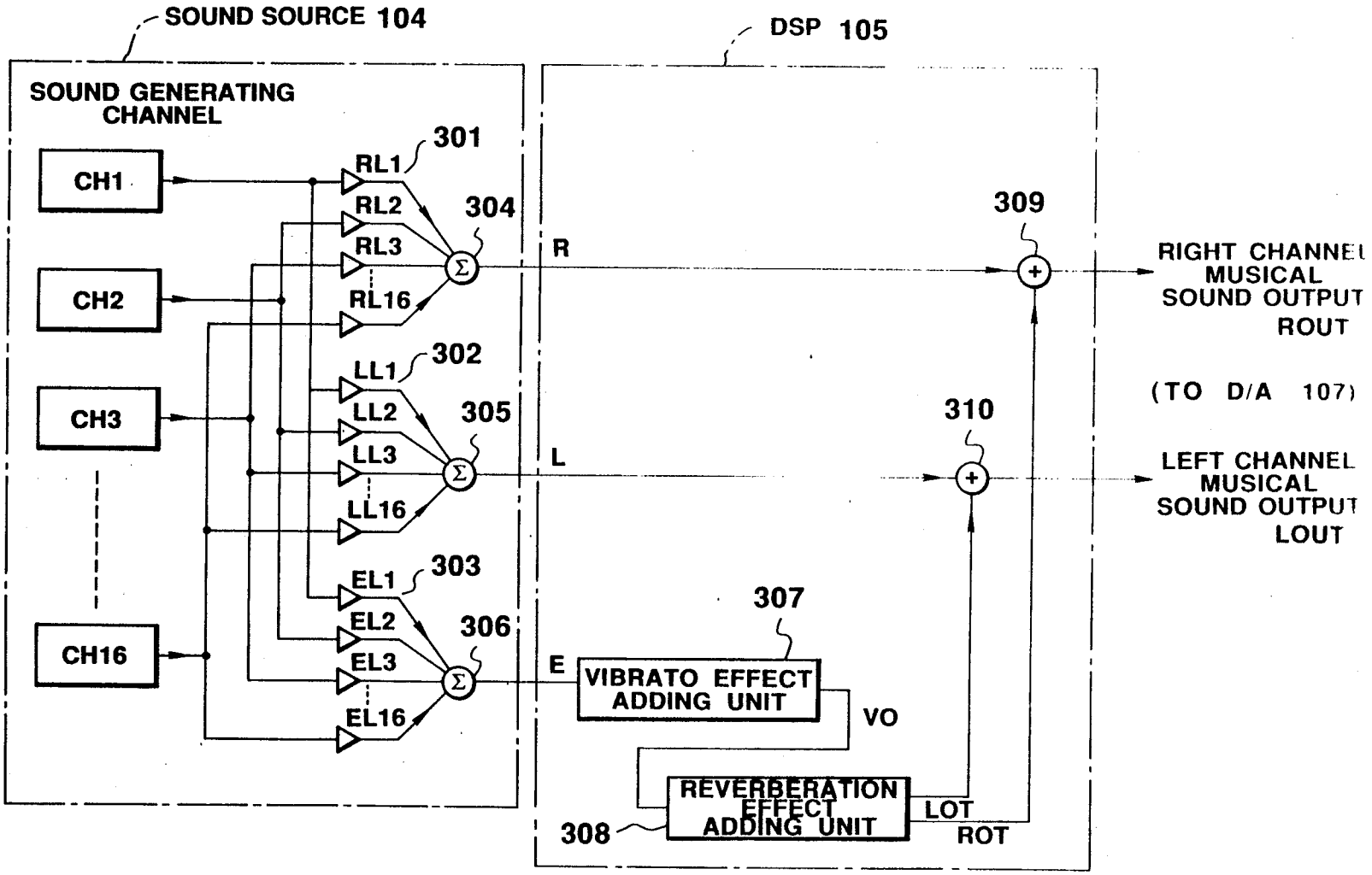
FIG. 3 is a block diagram used to explain a principle of operation of a sound source and the DSP of the present invention.

FIG. 3 is a block diagram of the sound source 104 of FIG. 1 and the DSP 105 of FIGS. 1 or 2, and to which reference will be made in explaining a principle operation of the sound source 104 and the DSP 105.

Referring to FIG. 3, the sound source 104 includes 16 sound generating channels CH1 through CH16 which are operated in a time division processing fashion. Outputs of the sound generating channels CH1 to CH16 are multiplied with three kinds of weighting parameters RLn, LLn and ELn (n denotes each of sound generating channels 0 to 16) by multipliers 301, 302 and 303 and accumulated at in three respective groups by adders 304 to 306. Respective accumulated results of the adders 304, 305 and 306 are supplied to the work memory (W) 204 (see FIG. 2 and FIG. 18 which will be referred to later) within the DSP 105 as a right channel direct sound R, a left channel direct sound L and a pedal effect feeding sound E. The abovementioned three kinds of parameters RLn, LLn and ELn are supplied from key follow tables of FIGS. 9A to 9C, which are stored in the ROM 102 of FIG. 1 as will be described later, in response to the key notes generated. In the key follow tables shown in FIGS. 9A to 9C, as will be described later, similarly to the string arrangement of the acoustic piano, the left and right channel direct sounds are localized to the right if the key note is high and are localized to the left if the key note is low and then generated. The resonance sound is set to be high if the key note is high and is set to be low if the key note is low.

As shown in FIG. 3, in the DSP 105, a vibrato effect is added to the pedal effect sound E set in the work memory (W) 204 (see FIG. 2) from the sound source 104 by a vibrato effect adding unit 307, and a vibrato output VO from the vibrato effect adding unit 307 is added with a reverberation effect by a reverberation effect adding unit 308. A reverberation right channel output ROT and a reverberation left channel output LOT from the reverberation effect adding unit 308 are respectively added with the right channel direct sound R and the left channel direct sound L by adders 309 and 310, thereby being supplied to the D/A converter 107 of FIG. 1 as a right channel musical sound output ROUT and a left channel musical sound output LOUT. A reverberation time RVT and a reverberation depth RVD, which will be described later, in the reverberation effect adding unit 308 can be successively varied by the stepped amount of the pedal 110 of FIG. 1.

Figure 4A:
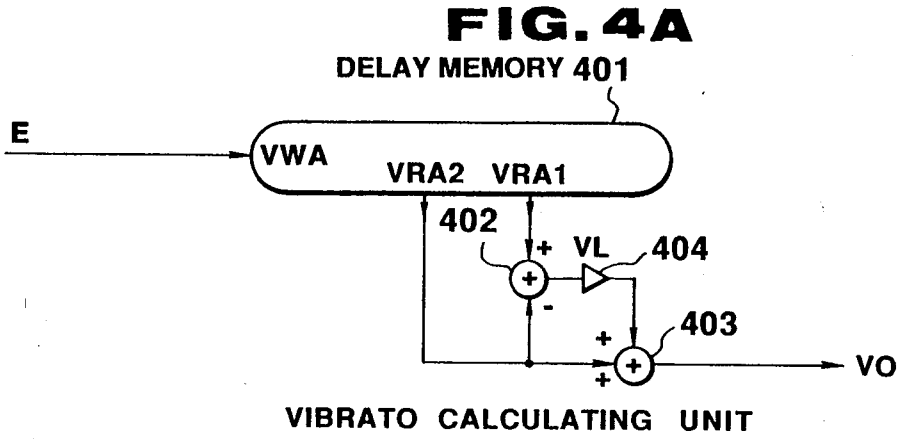
FIGS. 4A and 4B are respectively schematic block diagrams used to explain a principle of operation of a vibrato effect adding unit of the present invention.
Figure 4B:
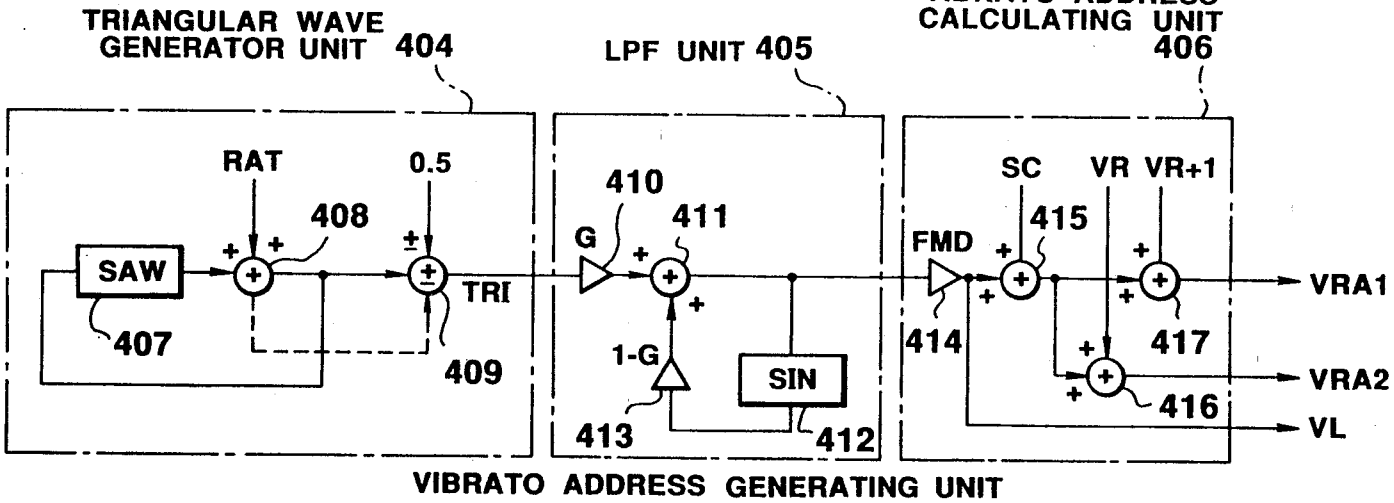

FIGS. 4A and 4B are respectively block diagrams of the vibrato effect adding unit 307 shown in FIG. 3, and to which reference will be made in explaining a principle of operation of the vibrato effect adding unit 307. This vibrato effect adding unit 307 is composed of a vibrato calculating unit shown in FIG. 4A and a vibrato address generating unit shown in FIG. 4B.

In the vibrator calculating unit shown in FIG. 4A, the pedal effect feeding sound E from the sound source 104 of FIG. 3 is delayed by a delay memory 401 and generated as the vibrato output VO. The write address in which the pedal effect feeding sound E is written in the delay memory 401 is supplied as a write address VWA which results from adding the count value SC, which increments at every sampling timing, to a vibrato write address offset VW of a certain value stored in the address offset memory (T) 205, which will be described later. Further, a read address in which the vibrato output is read from the delay memory 401 is supplied as two read addresses VRA1 and VRA2 which are added with the vibrato effect and which are generated from the following vibrato address generating unit. Then, two memory outputs read out from the two read addresses VRA1, VRA2 of the delay memory 401 are interpolated and calculated by using adders 402, 403 and a multiplier 403A to thereby obtain a vibrato output.

The vibrato address generating unit of FIG. 4B is composed of a triangular wave generating unit 404, a low-pass filter (LPF) unit 405 and a vibrato address calculating unit 406. On the basis of a sine wave LFO signal SIN which results from smoothing a triangular wave LFO (low frequency oscillation) output TRI generated from the triangular wave generating unit 404 by the LPF unit 405, the read addresses VRA1 and VRA2 are cyclically changed and the delay memory 401 is accessed by these read addresses VRA1, VRA2, whereby a vibrato output modulated by the low frequency is obtained.

In the triangular wave generator unit 404, a sawtooth wave LFO output SAW of the preceding sampling time is read out from a one sample delay unit 407 at every sampling timing and sequentially added with predetermined LFO rate corresponding values RAT, which will be described later, by an adder 408, thereby producing a signal value which increases in a linear fashion. At that time, the sawtooth wave LFO output SAW has a constant bit width. Assuming that the most significant bit (MSB) is a code bit, then the above output increases from 0 by each RAT value at every sampling timing. At the next timing in which the above value reaches the positive maximum value (the most significant bit is "0" and other bits are "1"), it jumps to the negative value (all bits are "1") and then increases toward the positive maximum value in a linear fashion one more time. That is, the sawtooth wave LFO output SAW derived from the adder 408 becomes a sawtooth wave low frequency cycle (LFO) signal which repeats the operation such that it increases from the negative value to the positive value in a linear fashion and then jumps to the negative minimum value one more time.

Further, in an adder and subtracter 409, if the sawtooth wave signal SAW is positive, then this signal value is added to a constant coefficient value 0.5 and if it is negative, then the sawtooth wave signal is subtracted from the coefficient value 0.5.

Thus, the adder and subtracter 409 derives the triangular wave LFO output TRI, the characteristic of which is as follows. The value thereof increases by every RAT value from the negative minimum value toward the positive maximum value in a linear fashion. When reaching the positive maximum value, it decreases by every RAT value toward the negative minimum value one more time in a linear fashion. When reaching the negative minimum value, it increase toward the positive maximum value one more time in a linear fashion.

The above triangular wave LFO output TRI is supplied to an LPF unit 405 composed of multipliers 410, 413, an adder 411 and a one sample delay unit 412, in which an overtone component of the triangular wave LFO output is cut and is thereby produced as a sine wave LFO output SIN.

Then, the sine wave LFO output SIN is supplied to a vibrato address calculating unit 406, wherein the vibrato read address offset VR is added to the count value SC incrementing at every sampling cycle by adders 415 and 416 to generate the read address VRA2 which changes in synchronism with the aforementioned write address VWA while holding a constant offset.

In the adder 415, the sine wave LFO output SIN which changes cyclically about the value 0 is added to the thus calculated address value to cause the address value to cyclically fluctuate, whereby a vibrato output VO frequency modulated by the low frequency sine wave LFO output SIN and which is added with the vibrato effect is read out from the delay memory 401 of the vibrato calculating unit of FIG. 4A. The changing width of the depth of the vibrato effect is controlled by a vibrato depth coefficient FMD which is multiplied with the sine wave LFO output SIN by the multiplier 414. The value of this coefficient FMD is automatically selected together with the LFO rate corresponding value RAT in response to the kind of the chord detected on the basis of the key note of the musical performance information. Alternatively, the value of this coefficient may be freely selected by the player by a switch, though not shown in FIG. 1.

The following interpolation calculation is performed in order to increase accuracy of the frequency modulation. Initially, the adder 416 generates the read address VRA2 on the basis of the vibrato write address offset VR and the adder 417 generates the read address VRA1 having the address value incremented by 1 from the address VRA2 on the basis of the vibrato write address offset VR+1. Then the subtracter 402 of FIG. 4A calculates a difference value between the two outputs read out from the adjacent two addresses VRA2, VRA1 of the delay memory 401. The multiplier 403A multiplies the above difference value with the value VL of the decimal part of the sine wave LFO output SIN derived from the multiplier 414 to calculate the changed amount corresponding to the decimal value. Then, the adder 403 adds the above changed amount to the output value of the address VRA2 to generate the vibrato output VO which is accurately interpolated.

Figure 5B:
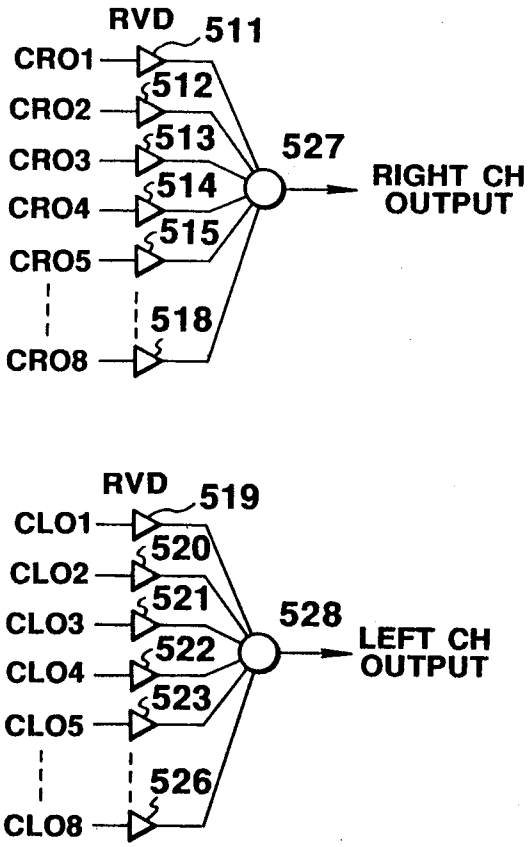
FIGS. 5A and 5B are respectively schematic block diagrams used to explain a principle of operation of a reverberation effect adding unit used of the present invention.
Figure 5A:
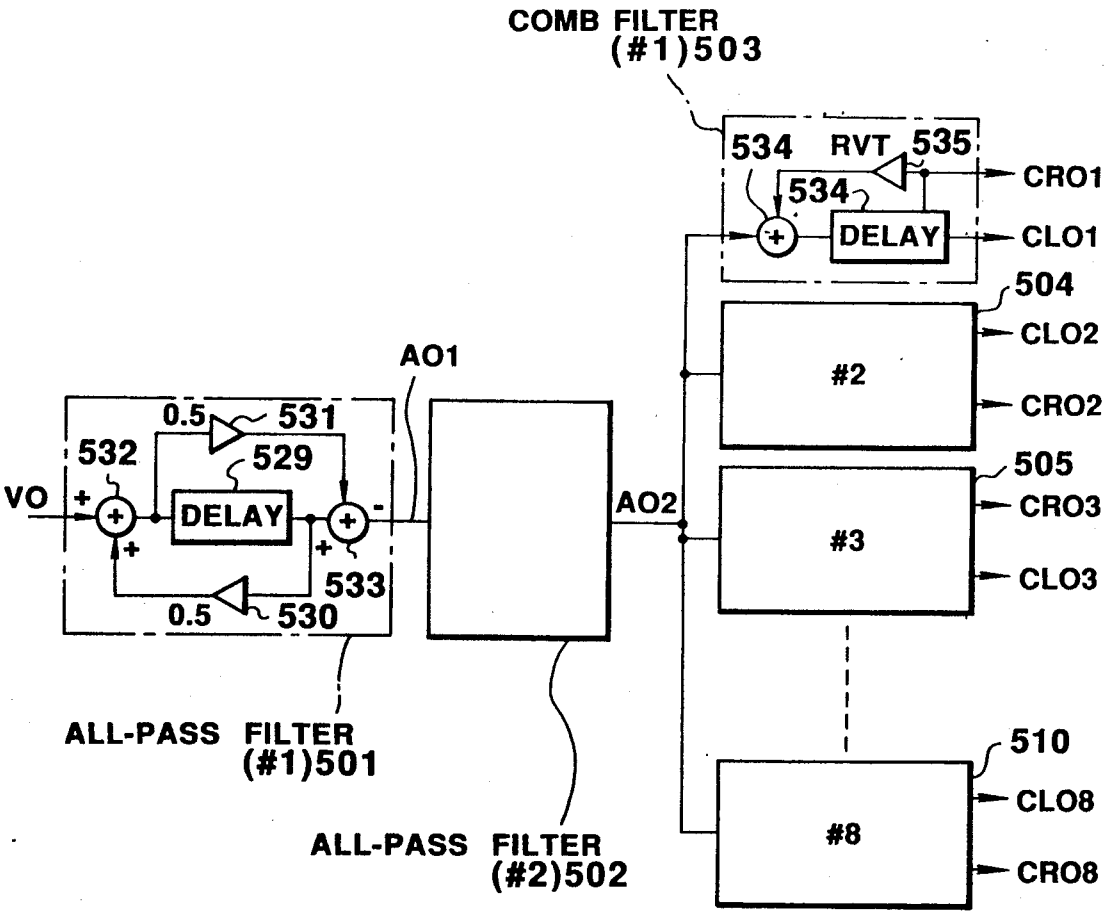

The changing width of the speed of the vibrato effect is controlled by the value of the LFO rate corresponding value RAT and this value is automatically changed and set in response to the kind of the playing chord made by the player as described above. This value may be freely set by the player by the switch, though not shown in FIG. 1. FIGS. 5A and 5B are block diagrams used to explain a principle of operation of the reverberation effect adding unit 308 of FIG. 3, respectively. The vibrato output VO of FIGS. 3 or 4 is supplied through #1, #2 all-pass filters 501 and 502 of two stages connected in series to eight comb filters 503 to 510 connected in parallel to each other.

The vibrato output VO is supplied to the first stage all-pass filter (all-band pass filter) 501, in which the delay component of the vibrato output VO is increased and supplied to the second stage all-pass filter 502 as an output signal AO1 having a number of delay components.

In the all-pass filter 502, the signal AO1 whose delay component is increased is further increased in delay component and a resultant output signal AO2 is supplied to a plurality of #1 to #8 comb filters 503 to 510 connected in parallel to each other.

While the two all-pass filters 501 and 502 are provided before the reverberation adding comb filters 503 to 510 as described above, it is needless to say that the number of the all-pass filters and connection method of the all-pass filters are not limited thereto and one or three all-pass filters may be employed. According to the experimental results obtained by the assignee of the present application, the best effect is achieved if two all-pass filters are connected in series.

The arrangement of the all-pass filters 501 and 502 will be described below. As shown in FIG. 5A, the all-pass filter 501, for example, is comprised of a delay element 529, multipliers 530, 531 and adders 532, 533. As described above, the all-pass filters 501 and 502 are arranged such that the output side is fed back through a multiplier 530 having a multiplying coefficient of 0.5 and the input side is fed forward through a multiplier 531 having a multiplying coefficient of 0.5 across the delay element 529. Thus, when the signal is input to the all-pass filters 501 and 502, then a number of delay components are generated therefrom on the basis of the input signal. Incidentally, the arrangements of the all-pass filters 501, 502 are not limited to the above-mentioned arrangement and all-pass filters of other types may be applied thereto, respectively.

The output signal data AO2 of the above-mentioned all-pass filter 502 is supplied to eight #1 to #8 comb filters 503 to 510 connected in parallel to each other. Each of the comb filters 503 to 510 is arranged as follows. As shown in FIG. 5B, the comb filter 503, for example, is comprised of a delay element 534, a multiplier 535 and an adder 536. The respective comb filters 503 to 510 derive left and right two channel output signals CLOi and CROi (i=1, 2, . . . 8) in which the aforementioned signal data AO2 is delayed by the amounts corresponding to different offset addresses (different offset addresses will be described later) by the respective delay elements 534 and in which the feedback amounts to the input are determined in response to the common reverberation time RVT supplied to the respective multipliers 535.

The right channel comb filter outputs CRO1, CRO2, . . . CRO8 are weighted by the common reverberation depth RVD by the multipliers 511 to 518 and accumulated by an accumulator 527, and then delivered to the adder 309 of FIG. 3 as a reverberation right channel output ROT. Similarly, left channel comb filter outputs CLO1, CLO2, . . . , CLO8 are weighted by the common reverberation depth RVD by the multipliers 519 to 526 and accumulated by an accumulator 528, and then delivered to the adder 310 of FIG. 3 as a reverberation left channel output LOT.

The reverberation time RVD supplied to the comb filters 503 to 510 can be varied by the stepped amount of the pedal 110 of FIG. 1, whereby different reverberation effects can be achieved.

The reverberation right channel output ROT and the reverberation left channel output LOT thus obtained are respectively added with a right channel direct sound R and a left channel direct sound L by the adders 309 and 310 and are supplied to the D/A converter 107 as the left channel musical sound output and the right channel musical sound output.

Specific operation of one embodiment of the arrangements of FIGS. 1 to 5B will be described sequentially.

Figure 6:
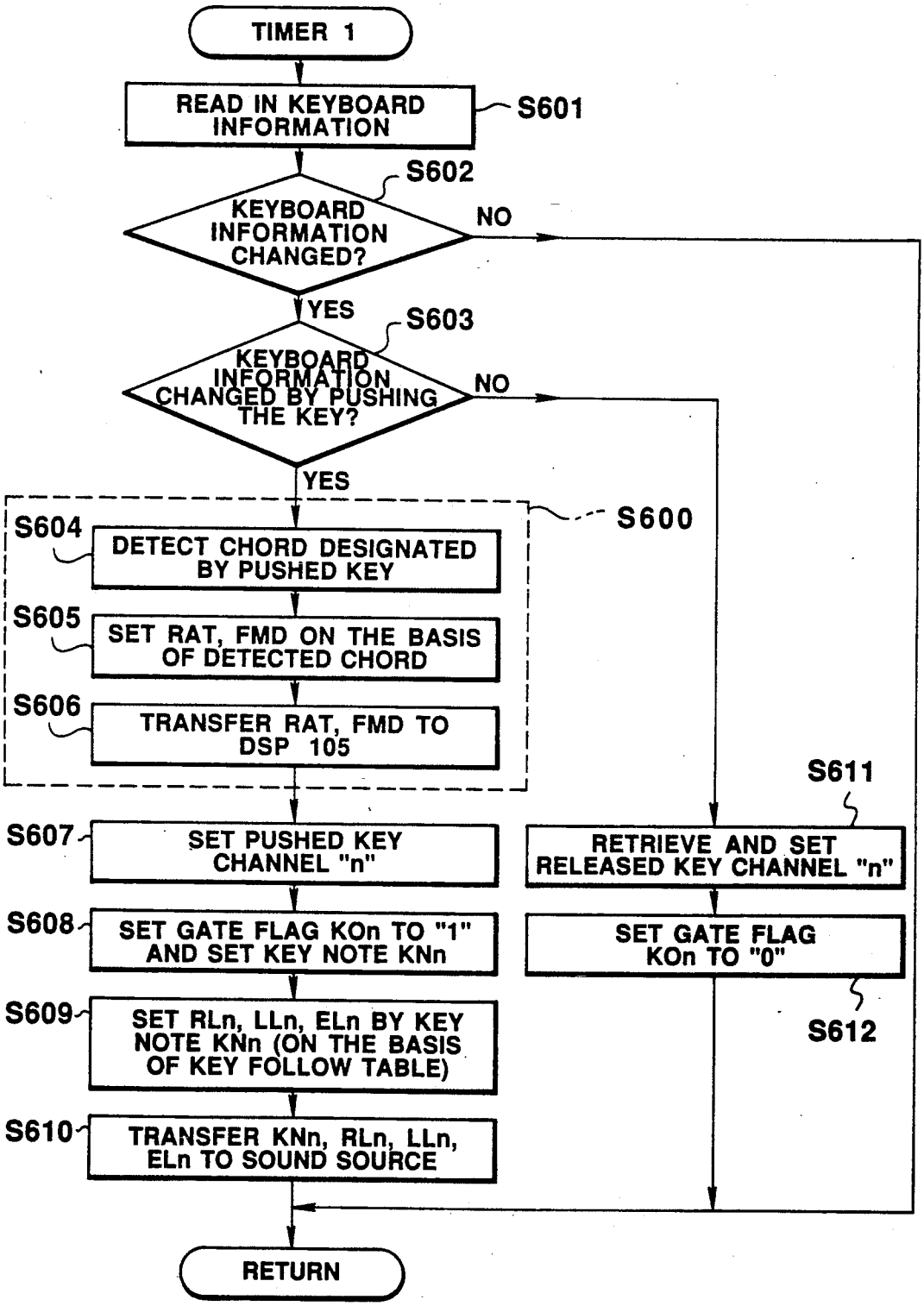
FIG. 6 is a flowchart to which references will be made in explaining a timer 1 processing of a central processing unit (CPU) of the present invention.
Figure 7:
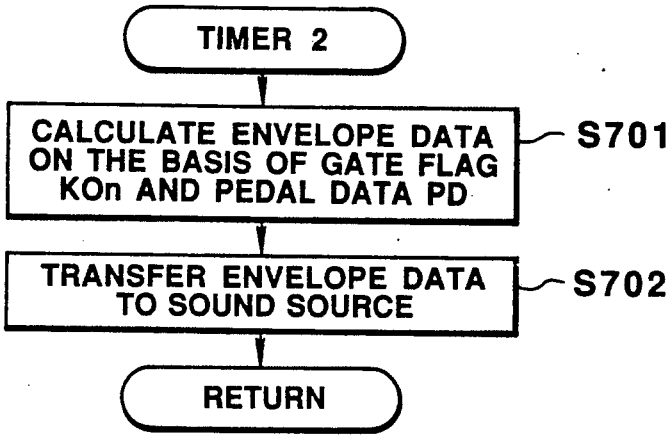
FIG. 7 is a flowchart to which references will be made in explaining a timer 2 processing of the CPU of the present invention.
Figure 8:
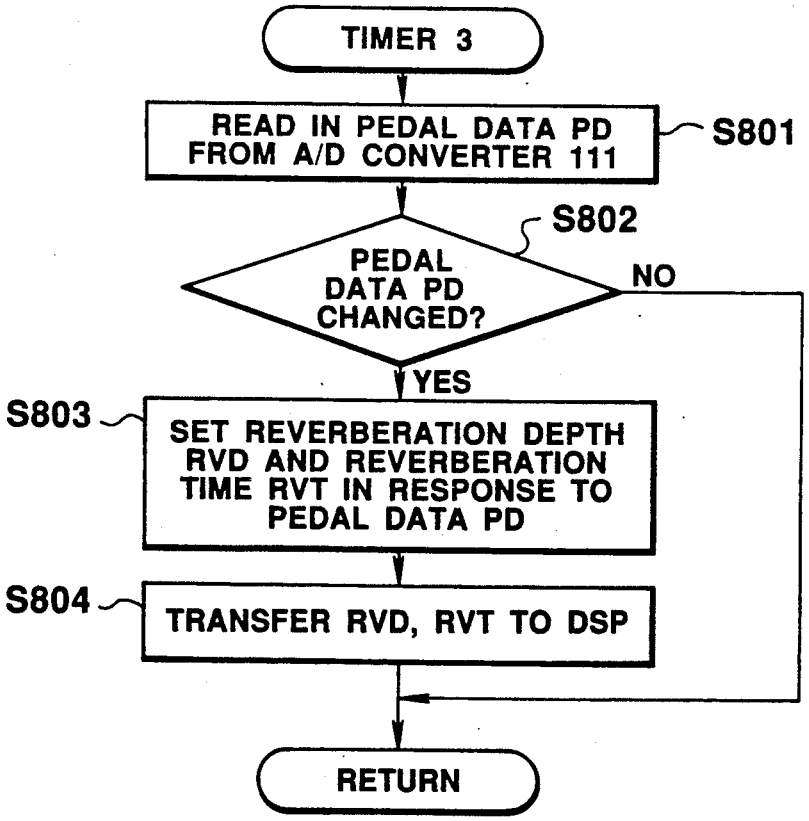
FIG. 8 is a flowchart to which references will be made in explaining a timer 3 processing of the CPU of the present invention.

Operation of the CPU 101 of FIG. 1 will be described with reference to operation flowcharts forming FIGS. 6 to 8. Operation of FIGS. 6 to 8 is executed as the processing in which the CPU 101 of FIG. 1 executes the program stored in the ROM 102 by utilizing the RAM 103 as a memory for work area. In this case, the CPU 101 executes the respective timer processings of FIGS. 6 to 8 at every interval of predetermined time in a timer interrupt fashion.

The timer 1 processing of FIG. 6 will be described. In this processing, the sound generation start instruction is given to the sound source 104 and various weighting parameters are set.

Initially, a keyboard information is supplied to the CPU 101 from the keyboard 108 through the interface circuit 109 and the bus 114 at step S601.

Then, it is determined in the next decision step S602 whether or not the keyboard information is changed from the previous reading.

If the keyboard information is not changed as represented by a NO at decision step S602, then no processing is made and the timer 1 processing is ended.

If the keyboard information is changed as represented by a YES at decision step S602, then the processing proceeds to the next decision step S603. It is determined in decision step S603 whether or not such change of keyboard information is brought by pushing the key.

If the keyboard information is changed by pushing the key as represented by a YES at decision step S603, then the processing proceeds to the next step S604, wherein a code of chord constructed by pushing the key is detected. In this detection, key notes of all keys pushed and a chord constructing note table (not shown) of, for example, the ROM 102 and in which key note groups constructing respective chords are verified to detect the kind (code) of the chord is detected.

In the next step S605, the LFO rate corresponding value RAT and the vibrato depth coefficient FMD are set on the basis of the detected code. When the LFO rate corresponding value RAT and the vibrato depth coefficient FMD are set, code numbers 1, 2, 3, . . . are allocated to code names maj, min, 7th, m7th, dim, aug, sus, . . . for example. If the code number becomes smaller, then the LFO rate corresponding value RAT becomes larger, that is, the vibrato effect is selected to be slow and the vibrato depth coefficient FMD is selected to be larger. If on the other hand the code number is larger, then the LFO rate corresponding value RAT is made smaller, that is, the vibrato effect is selected to be quick and the vibrato depth coefficient FMD is selected to be smaller. It is needless to say that the above values may be set in a reverse manner, that is, if the code number is smaller, then the LFO rate corresponding value RAT is made smaller, while if the code number is larger, then the LFO rate corresponding value RAT is made larger.

The LFO rate corresponding value RAT and the vibrato depth coefficient FMD thus set in the RAM 103 as described above are transferred to the DSP 105 at step S606.

In other embodiments which will be described later, the processings of the steps S604, S605 and S606 shown by a broken line block S600 are removed and instead, other processing is executed.

Subsequently, a vacant channel is selected from sixteen sound generating channels (see the aforementioned description of FIG. 3) and is referred to as a pushed key channel "n" at step S607.

Then, "1" is set in a gate flag KOn which is a variable corresponding to the pushed key channel "n" and which is stored in the RAM 103. There are provided flags of sixteen sound generating channels and if the value of flag is "1", then this means that the sound generating channel is placed in the key pushed state. Further, the key note corresponding to the pushed key is set in a key note KNn which is a variable corresponding to the pushed key channel "n" and which is stored in the RAM 103 at step S608. There are provided the key notes KNn of sixteen sound generating channels.

Figure 9A:
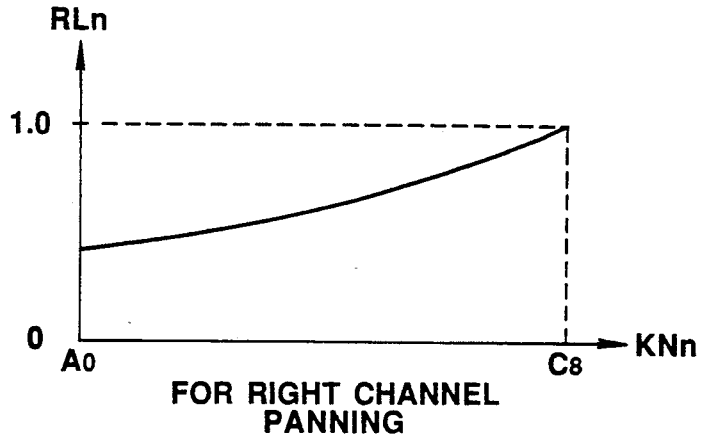
FIGS. 9A to 9C are respectively schematic representations of key follow tables.
Figure 9B:
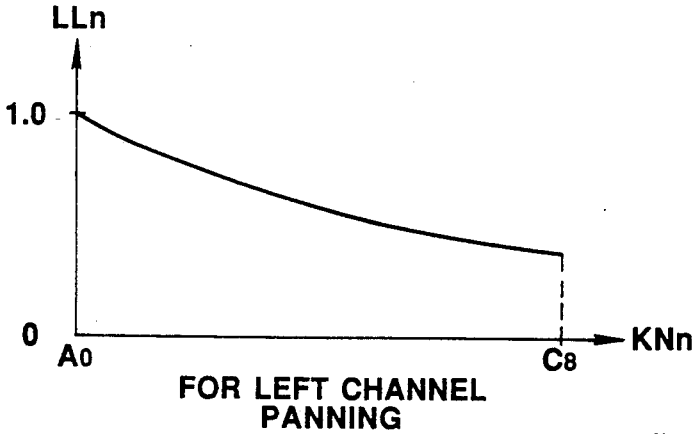
Figure 9C:
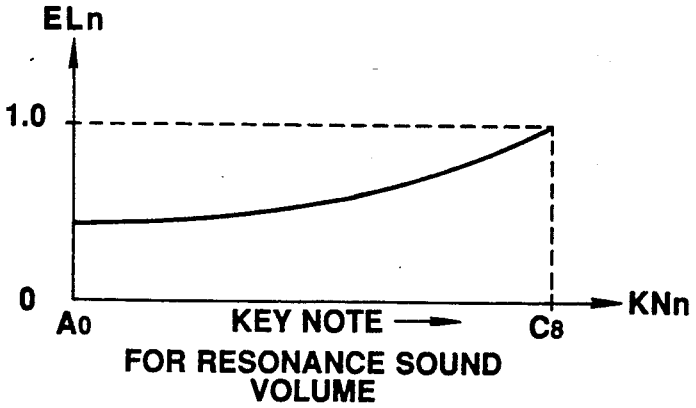

A right channel panning weighting parameter RLn, a left channel panning weighting parameter LLn and a resonance sound volume weighting parameter ELn corresponding to the key note KNn are read out from a key follow table within the ROM 102 and set in the RAM 103 at step S609. FIGS. 9A to 9C show one example of conversion characteristics of the key follow table stored in the ROM 102. FIG. 9A shows a right channel panning key follow table, in which when the key note KNn indicates a high note key, the right channel panning weighting parameter RLn of larger value is output. FIG. 9B shows a left channel panning key follow table, in which when the key note KNn indicates a high note key, a left channel panning weighting parameter LLn of smaller value is output. Further, FIG. 9C shows a resonance sound volume key follow table, in which when the key note KNn indicates a high note key, a resonance sound volume weighting parameter of larger value ELn is output.

Then, the key note KNn, the right channel panning weighting parameter RLn, the left channel panning weighting parameter LLn and the resonance sound volume weighting parameter ELn set in the RAM 103 as described above are transferred to the sound source 104 at step S610.

The sound source 104 is adapted to generate a digital musical sound signal at every sound generating channel in a time division manner according to the existing digital signal processing technique. Outputs of the respective sound generating channels are multiplied with the three kinds of the weighting parameters RLn, LLn and ELn transferred from the CPU 101 by the above processing by the multipliers 301, 302 and 303, accumulated at every three groups by the adders 304 to 306 and delivered as the right channel direct sound R, the left channel direct sound L and the pedal effect feed sound E, respectively.

The above-mentioned three kinds of parameters RLn, LLn and ELn are supplied on the basis of the conversion characteristics of the key follow table shown in FIGS. 9A to 9C in response to the key note KNn whose sound is generated. Due to these characteristics, similarly to the string arrangement of the acoustic piano, the left and right channel direct sounds are localized more to the right if the key note is high and is localized more to the left if the key note is low. The resonance sound is localized to the high level if the key note is higher, and is localized to the low level if the key note is lower.

If it is determined in decision step 603 that the key information is not changed by pushing the key, then a release key channel "n" is retrieved by comparing the key note of the released key with the key notes KNn of the sound generating channels of the pushed keys registered in the RAM 103 (step S611).

In the next step S612, the gate flag KOn corresponding to that sound generating channel stored in the RAM 103 is set to "0" and then the key release instruction is supplied to the sound source 104.

The timer 2 processing of FIG. 7 will be described below. In the timer 2 processing, envelope data is set in the sound source 104.

Referring to FIG. 7, at step S701, envelope data for controlling volume and timbre of musical sound are calculated on the basis of the gate flag KOn (see step S608 of FIG. 6) set in the RAM 103 and pedal data PD indicative of the stepped amount of the pedal 110 supplied thereto through the A/D converter 111 and the bus 114. That is, envelope data starts being made with respect to the sound generating channels in which the gate flag KOn is newly set to "1" and values of envelope data composed of rate values and target levels corresponding to respective sections of ADSR (attack, decay, sustain, release) from the start to the end of sound generation can be controlled on the basis of the pedal data.

The thus obtained envelope data are transferred to the sound source 104 in step S702.

The sound source 104 generates an envelope signal on the basis of the envelope data to control the envelope of volume or timbre of the musical sound generated.

The timer processing 3 of FIG. 8 will be described below. In the timer processing 3, the reverberation depth RVD and the reverberation time RVT are set in the DSP 105.

In step S801, the stepped amount of the pedal 110 supplied from the A/D converter 111 is supplied to the CPU 101 as the pedal data PD which is the variable stored in the RAM 103.

It is determined in the next decision step S802 whether or not the pedal data PD is changed since the last time it was supplied.

If the pedal data PD is not changed at all as represented by a NO in decision step S802, then no processing is executed and the timer 3 processing is ended.

Figure 10:
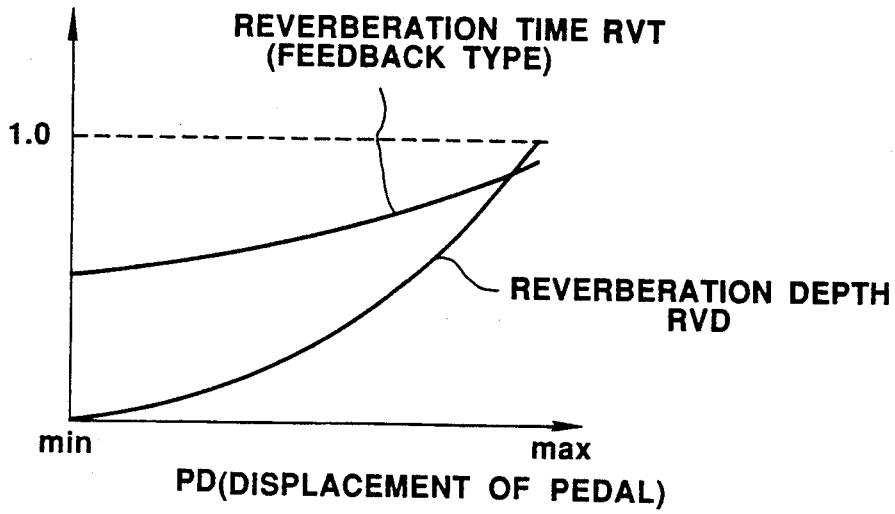
FIG. 10 is a schematic representation of a reverberation table.

If the pedal data is changed as represented by a YES at decision step S802, then the processing proceeds to step S803, whereat the reverberation table on the ROM 102 is accessed in response to the value of the changed pedal data PD, whereby corresponding reverberation depth RVD and reverberation time RVT are read out from the reverberation table and set in the RAM 103. FIG. 10 shows an example of conversion characteristics of the reverberation table.

In the next step S804, the thus obtained reverberation depth RVD and reverberation time RVT are transferred to the coefficient memory (P) 203 (see FIG. 2 and FIG. 17 which will be described later) within the DSP 105.

The reverberation depth RVD and the reverberation time RVT are supplied to the comb filters 503 to 510 and to the multipliers 511 to 526 as earlier noted with reference to FIG. 5 and are changed by the pedal stepped amount on the basis of the table characteristics shown in FIG. 10, whereby different reverberation sounds are obtained. That is, if the stepped amount of the pedal 110 is large, then the reverberation effect becomes powerful and the reverberation time is extended. It is needless to say that this characteristic can be varied arbitrarily.

Operation of the DSP 105 of FIGS. 1, 2 and 3 will be described with reference to operation flowcharts of FIGS. 11 to 16. Incidentally, these operations are realized as the processing in which the DSP 105 of FIGS.

1 or 2 executes the micro-program stored in the program memory 201.

In the respective operation flowcharts, P (RAT), for example, is stored in the coefficient memory (P) 203 of FIG. 2 and whose name indicates the content of the coefficient (constant)of RAT. In a like manner, W (SAW) and T (VW) are respectively stored in the work memory (W) 204 and the address offset memory (T) 205 and whose names indicate the contents of variables (constants may be possible) of SAW and VW. Addresses and names of coefficients (constants) or variables stored in the respective memories are represented in FIGS. 17 to 19. Further, E(EA) is assumed to indicate the content of the address designated by the address value of the register (EA) 228 of the delay memory (E) 106 shown in FIG. 2.

Figure 11:
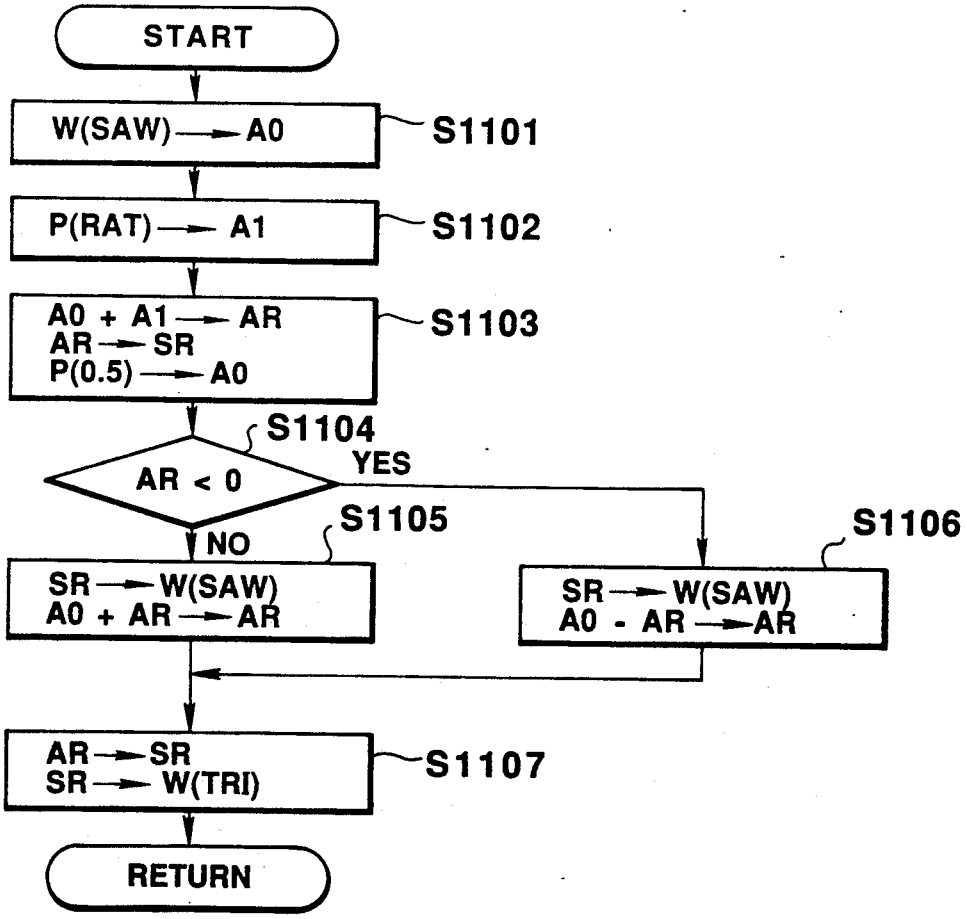
FIG. 11 is a flowchart to which references will be made in explaining operation of a triangular wave generator unit of the present invention.
Figure 12:
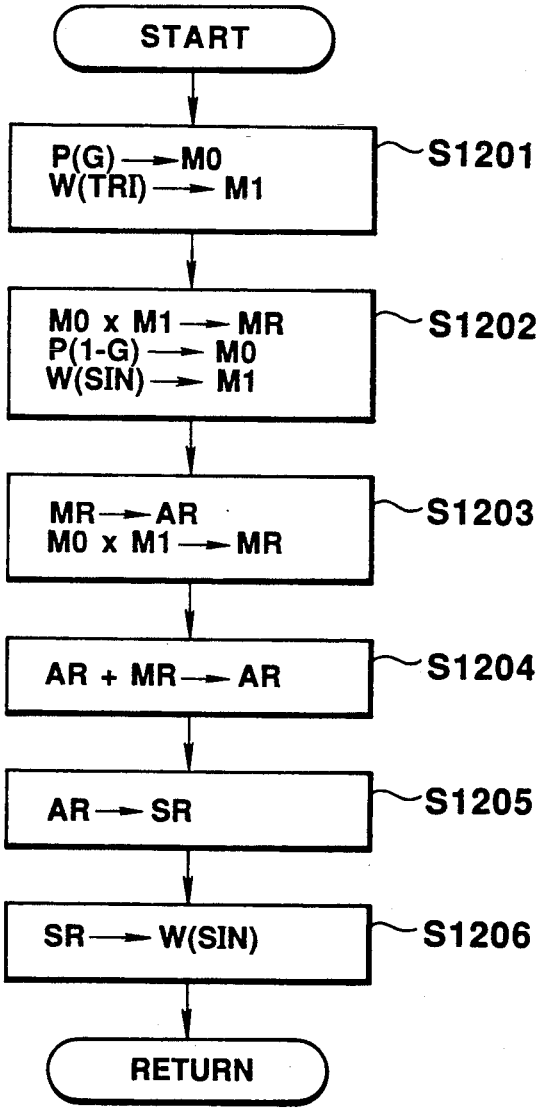
FIG. 12 is a flowchart to which references will be made in explaining operation of a low-pass filter (LPF) unit of the present invention.
Figure 13:
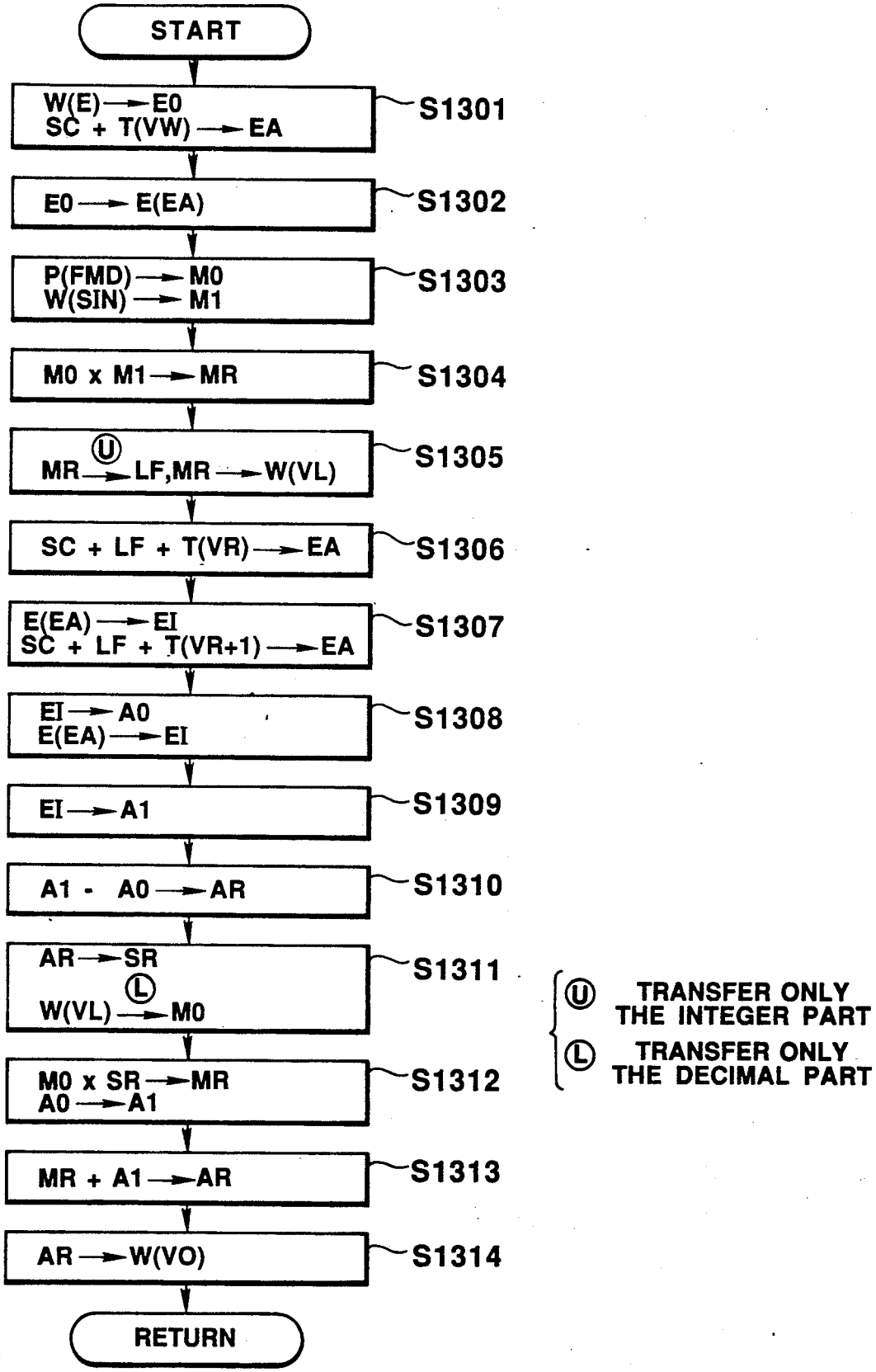
FIG. 13 is a flowchart to which references will be made in explaining operation of a vibrato calculating unit of the present invention.

Referring to FIGS. 11 to 13, let us describe the processing that the DSP 105 of FIGS. 1 or 2 executes in order to realize the function of the reverberation effect adding unit 308 of FIGS. 3 or 4.

FIG. 11 is a flowchart of the processing operation that the DSP 105 of FIGS. 1 or 2 executes in order to realize the function of the triangular wave generator unit 404 of FIG. 4B.

As shown in FIG. 11, a content (see FIG. 18) of the sawtooth wave LFO output SAW is read out from the work memory (W) 204 and set in the register (A0) 214 at step S1101. Incidentally, the initial value of this value may be determined freely.

Then, a content (see FIG. 17) of the LFO rate corresponding value RAT is read out from the coefficient memory (P) 203 and set in the register (A1) 215 at step S1102.

The value of the register (A0) 214 and the value of the register (A1) 215 are added by the adder and subtracter 217 and the added result is supplied to the register (AR) 222 whose content is further stored in the register (SR) 224 at step S1103. Thus, the processing equivalent to the function of the adder 408 shown in FIG. 4B can be realized.

Simultaneously, the constant 0.5 (see FIG. 17) stored in the coefficient memory (P) 203 is stored in the register (A0) 214, similarly at step S1103.

It is determined in the next decision step S1104 whether or not the added result of the register (AR) 2 is negative.

If the content of the register (AR) 222 is positive as represented by a NO at decision step S1104, then the content (=content of the register (AR) 222) of the register (SR) 224 is stored in the work memory (W) 204 as a new sawtooth LFO output SAW, and also the content of the register (AR) 222 is added to the constant 0.5 stored in the register (A0) 214 by the adder and subtracter 217, the added result of which is supplied to the register (AR) 222 at step S1105.

If on the other hand the content of the register (AR) 222 is negative as represented by a YES at decision step S1104, then a content (=content of the register (AR) 222) of the register (SR) 224 is stored in the work memory (W) 204 as a new sawtooth wave LFO output SAW, and the content of the register (AR) 222 is subtracted from the constant 0.5 stored in the register (A0) 214 by the adder and subtracter 217, the subtracted result of which is newly supplied to the register (AR) 222 at step S1106.

By the above-mentioned operation, the processing equivalent to the function of the adder and subtracter 409 of FIG. 4B can be realized.

The value thus obtained in the register (AR) 222 is transferred to the register (SR) 224 and then stored in the work memory (W) 204 (see FIG. 18) as the triangular wave LFO output TRI at step S1107.

FIG. 12 shows a flowchart of the processing operation that the DSP of FIGS. 1 or 2 executes in order to realize the function of the LPF unit 405 of FIG. 4B.

Referring to FIG. 12, an LFO filter coefficient G (see FIG. 17) of the coefficient memory (P) 203 is read out to the register (M0) 212. Further, by the processing shown in FIG. 11, the content of the triangular wave LFO output TRI stored in the work memory (W) 204 is read out to the register (M1) 213 at step S1201.

The value of the register (M0) 212 and the value of the register (M1) 213 are multiplied by the multiplier 216, and the multiplied result from the multiplier 216 is supplied to the register (MR) 221 at step S1202, thereby realizing the processing equivalent to the function of the multiplier 410 of FIG. 4B.

Simultaneously, an LFO filter coefficient 1−G (value resulting from subtracting G from 1) of the coefficient memory (P) 203 is supplied to the register (M0) 212 and the sine wave LFO output SIN (see FIG. 18) on the work memory (W) 204 is supplied to the register (M1) 213, similarly in step S1202.

Then, the result in which the triangular wave LFO output TR1 obtained in the register (MR) 221 is multiplied with the coefficient G is transferred through the adder and subtracter 217 to the register (AR) 222 at step 1203.

Also, in the multiplier 216, the value set in the register (M0) 212 and the value set in the register (M1) at step S1102 are multiplied and the multiplied result is obtained at the register (MR) 221 (similarly in step S1203). Thus, the processing equivalent to the function of the multiplier 413 shown in FIG. 4B is realized.

In the adder and subtracter 217, the value of the register (AR) 222 and the value of the register (MR) 221 are added, and the added result is newly set in the register (AR) 222 in step S1204. In step S1205, this content is further stored in register (SR) 224, thereby realizing the processing equivalent to the function of the adder 411 of FIG. 4B.

The value obtained in the register (SR) 224 is stored in the work memory (W) 204 as a new sine wave LFO output SIN in step S1206.

FIG. 13 is a flowchart of the processing operation executed by the DSP 105 of FIG. 1 or 2 in order to realize the functions of the vibrato address calculating unit 406 of FIG. 4B and the vibrato calculating unit of FIG. 4A.

As earlier described with reference to FIG. 3, the pedal effect feed sound E (see FIG. 18) generated by the sound source 104 and which is stored in the work memory (W) 204 (see FIG. 2) within the DSP 105 is supplied to the register (EO) 229. Further, the vibrato write address offset VW (see FIG. 19) read out from the address offset memory (T) 205 is added to the count value SC, which is generated from the control circuit 202 at every sampling timing, by the adder 227. The added value is set in the register (EA) 228 as a write address VWA in step S1301.

The pedal effect feeding sound E supplied to the register (EO) 229 is written in the write address VWA set in the register (EA) 228 of the delay memory (E) 106 (in step S1302), whereby the processing equivalent to the function in which the pedal effect feed sound E is written in the delay memory 401 is realized.

Then, the vibrato depth coefficient FMD stored in the coefficient memory (P) 203 is supplied to the register (M0) 212. Further, the sine wave LFO output SIN obtained in the work memory (W) 204 by the processing of FIG. 12 is supplied to the register (M1) 213 (in step S1303).

The value of the register 212 (MO) and the value of the register (M1) 213 are multiplied and the multiplied result is obtained in the register (MR) 221 in step S1304, whereby the processing equivalent to the function of the multiplier 414 of FIG. 4B is realized.

The integer part (high order bit) obtained at the above register (MR) 221 is stored in the register (LF) 231 through the adder and subtracter 217 and the register (AR) 222. The value of the register (MR) 221 is stored in the address 08 of the work memory (W) 204 as interpolation LFO data VL (see FIG. 18) in step S1305.

In the adder 227, the integer part of the above multiplied result read to the register (LF) 231 is added to the count value SC, which is generated from the control circuit 202 at every sampling timing, and temporarily stored in the register (ER) 232. Further, the vibrato read address offset VR (see FIG. 19) read out at the address offset memory (T) 205 is added to the value of the register (ER) 232 by the adder 227. The resultant added value is set in the register (EA) 228 as the read address VRA2 in step S1306, whereby the processing equivalent to the functions of the adders 415 and 416 of FIG. 4B is realized.

The delay memory (E) 106 is accessed by the read address VRA2 set in the above register (EA) 228, and waveform data (see step S1302) written at the sampling timing before the preceding time is read out at the address of the delay memory (E) 106. Then, this waveform data is stored in the register (E1) 230 (step S1307), whereby the processing equivalent to the function in which data is read out from the address VRA2 of the delay memory 401 of FIG. 4A is realized.

Further, the integer part of the aforementioned multiplied result read to the register (LF) 231 is added to the count value SC, which is generated from the control circuit 202 at every sampling timing, by the adder 227 and temporarily stored in the register (ER) 232. Furthermore, a vibrato read address offset VR+1 see FIG. 19) read out from the address offset memory (T) 205 is added to the value of the register (ER) 232 by the same adder 227 and the added value is set in the register (EA) 228 as the read address VRA1 (in the same step S1307), whereby the processing equivalent to the functions of the adders 415 and 417 of FIG. 4B is realized.

In step S1308, the output value supplied to the register (EI) 230 from the address VRA2 is saved in the register (A0) 214, and thereafter, the delay memory (E) 106 is accessed by the read address VRA1 set in the register (EA) 228 to thereby read out at the address thereof waveform data (see step S1302) which is written at the sampling timing before the previous time. The thus read-out waveform data is stored in the register (EI) 230 (step S1308), whereby the processing equivalent to the function in which data is read out from the address VRA1 of the delay memory 401 of FIG. 4A is realized.

The output developed at the register (EI) 230 from the address VRA1 is stored in the register (A1) 215 in step S1309.

In the adder and subtracter 217, the output value stored in the register (A0) 214 at the address VRA2 is subtracted from the output value stored in the register (A1) 215 at the address VRA1, and the subtracted result is supplied to the register (AR) 222 (in step S1310), whereby the processing equivalent to the function of the subtracter 402 of FIG. 4A is realized.

The content of the register (AR) 222 is further stored in the register (SR) 224 in step S1311.

A decimal part (lower order bit) of the interpolation LFO data VL stored in the work memory (W) 204 by the processing of step S1305 is read in the register (M0) 212 similarly in step S1311.

The value of the register (M0) 212 and the difference value of the register (SR) 224 are multiplied with each other by the multiplier 216 and the multiplied result is obtained in the register (MR) 221 in step S1312, whereby the processing equivalent to the multiplier 404 of FIG. 4A is realized.

At the same time, the output value of the address VRA2 and which is stored in the register (A0) 214 in step S1308 is transferred to the register (A1) 215 similarly in step S1312.

The value of the register (MR) 221 and the value of the register (A1) 215 are added to each other by the adder and subtracter 217 and the added result is supplied to the register (AR) 222 in step S1313, whereby the processing equivalent to the function of the multiplier 403 of FIG. 4A is realized.

Then, the added result obtained at the register (AR) 222 is stored in the address 09 of the work memory (W) 204 as a vibrato output VO in step 1314 (see FIG. 18).

As described above, the DSP 105 in FIGS. 1 or 2 repeatedly executes the processing programs shown in the operation flowcharts of FIGS. 11 to 13 at every sampling timing to thereby realize the function of the vibrato effect adding unit 307 of FIGS. 3 or 4.

Operation of the DSP 105 of FIG. 1 or 2 for realizing the function of the reverberation effect adding unit 308 of FIGS. 3 or 5 will be described below with reference to operation flowcharts forming FIGS. 14 to 16.

Figure 14:
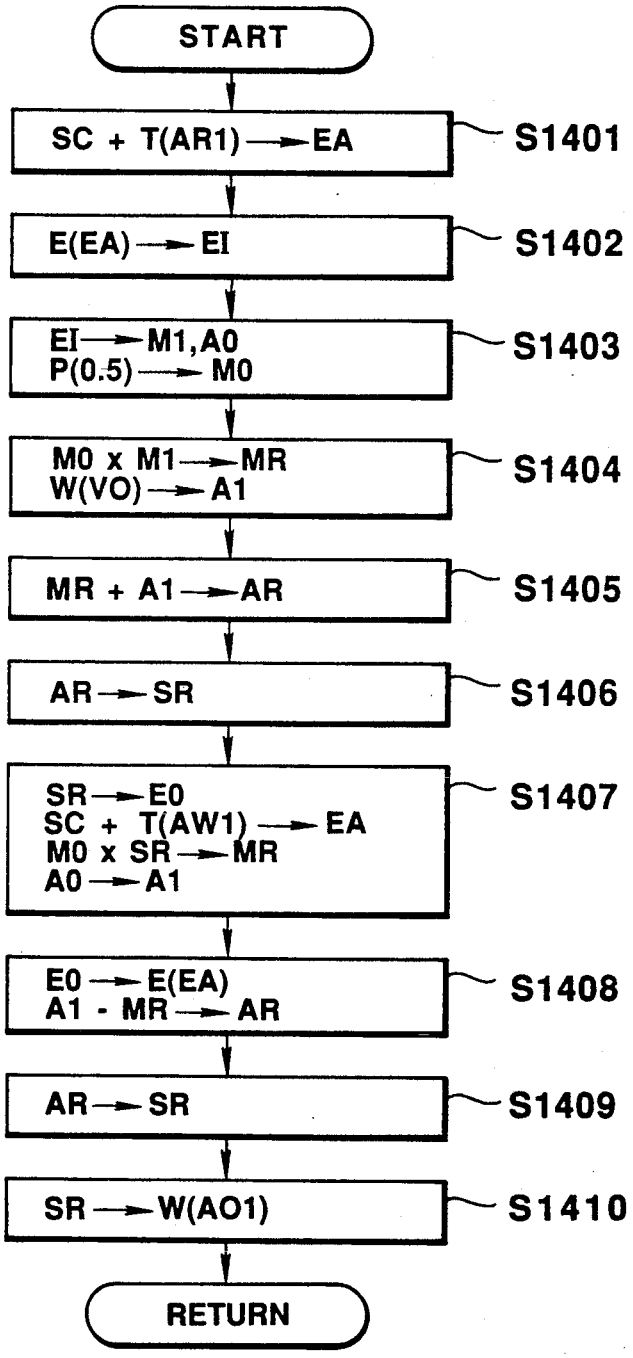
FIG. 14 is a flowchart to which references will be made in explaining operation processing that the DSP executes to realize the function of an all-pass filter in the reverberation effect adding unit of the present invention.

The flowchart of FIG. 14 shows the processing operation that is executed by the DSP 105 of FIG. 1 or in order to realize the function of the all-pass filter 501 of FIG. 5.

A read address offset AR1 (see FIG. 19) read out from the address offset memory (T) 205 to the all-pass filter 501 is added to the count value SC, which is generated from the control circuit 202 at every sampling timing, by the adder 227 and the resultant added value is set in the register (EA) 228 as an address value in step S1401.

The delay memory (E) 106 is accessed by the address value set in the register (EA) 228 and waveform data, which is written therein at the sampling timing before the previous time is, read out at the address of the delay memory (E) 106. The thus read waveform data is stored in the register (EI) 230 in step S1402.

The above-mentioned waveform value stored in the register (EI) 230 is transferred to the register (M1) 213 and the register (A0) 214. Simultaneously, the coefficient value 0.5 is read out from the coefficient memory (P) 203 and set in the register (M0) 212 in step S1403.

The value of the register (M0) 212 in which the coefficient value 0.5 is set and the value of the register (M1) 213 in which the waveform value from the delay memory (E) 106 is set are multiplied with each other by the multiplier 216 and the multiplied value is set in the register (MR) 221 in step S1404.

By the above-mentioned operations of steps S1401 to S1404, it is possible to realize the processing equivalent to the function of the all-pass filter 501 of FIG. 5 in which the waveform value of one sampling cycle before is read out from the delay element 529 and is multiplied with the multiplying coefficient 0.5 by the multiplier 530.

Also, the vibrato output VO generated by the processing in the aforementioned vibrato effect adding unit 307 is read out from the work memory (W) 204 and set in the register (A1) 215 similarly in step S1404.

The value of the register (MR) 221 in which the aforementioned multiplied value is set is added to the value of the vibrato output VO set in the above register (A1) 215 by the adder and subtracter 217 and the added value is set in the register (AR) 222 in step S1405. This added result from the register (AR) 222 is transferred to the output register (SR) 224 in step S1406, whereby the processing equivalent to the function of the adder 532 of the all-pass filter 501 is realized.

Then, the value of the register (SR) 224 is stored in the register (EO) 229. The write address offset AW1 read in the all-pass filter 501 from the address offset memory (T) 205 is added to the sampling count value SC by the adder 227 and the added value is set in the register (EA) 228 at step S1407.

Also, the value of the register (M0) 212 in which the coefficient value 0.5 is set and the value of the register (SR) 224 in which the added value is set in step S1406 are multiplied with each other by the multiplier 216 and the resultant multiplied value is set in the register (MR) 221 similarly in step S1407, whereby the processing equivalent to the processing done by the multiplier 531 in the all-pass filter 501 of FIG. 5 is realized.

Similarly in step S1407, the waveform data of the previous sampling timing from the delay memory 106 and which is stored in the register (A0) 214 in the above step S1403 is transferred to the register (A1) 215.

Then, the value set in the register (EO) in step S1407 is stored in the delay memory (E) 106 by using the value, which is calculated in step S1407 and stored in the register (EA) 228, as the address, whereby the processing equivalent to the function in which the output of the adder 532 in the all-pass filter 501 is stored in the delay element 529 is realized.

The multiplied result similarly developed in the register (MR) 221 is subtracted from the waveform data set in the register (A1) 215 in step S1407 by the adder and subtracter 217, and the subtracted result is stored in the register (AR) 222 similarly in step S1408. Further, the values set in the register (AR) 222 are transferred to, the output register (SR) 224 in step S1409, whereby the processing equivalent to the function of the adder 533 in the all-pass filter 501 in FIG. 5 is realized.

Finally, the output result obtained in the above output register (SR) 224 is stored in the work memory (W) 204 as the data AO1 in step S1410, thereby the output signal AO1 of the all-pass filter 501 of FIG. 5 is obtained.

As described above, the DSP 105 in FIGS. 1 or 2 repeatedly executes the processing program shown in the operation flowchart of FIG. 14 at every sampling timing to thereby realize the function of the all-pass filter 501 shown in FIG. 5.

In order to realize the function of the all-pass filter 502, a right channel address offset CRR1 read from the address offset memory (T) 205 to the comb filter 503 is added to the count value SC generated from the control circuit 202 at every sampling timing by the adder 227, and the added value is set in the register (EA) 228 as the address value in step S1501.

The delay memory (E) 106 is accessed by the address value set in the register (EA) 228 and the waveform data written in the delay memory (E) 106 at the previous sampling timing is read out at the address of the stored in the register (EI) 230 as right channel waveform data in step S1502.

A left channel address offset CLR1 read from the address offset memory (T) 205 to the comb filter 503 is added to the count value SC generated from the control circuit 202 at every sampling timing by the adder 227, and the added value is set in the register (EA) 228 as the address value in step S1503.

The right channel waveform data set in the register (E1) 230 at step S1503 is transferred to the register (M0) 212 and stored in the work memory (W) at its address 0C shown in FIG. 18 as the right channel output CRO1 of the comb filter 503 (similarly in step S1503), thereby realizing the processing equivalent to the function in which the delay element 534 of the comb filter 503 in FIG. 5 derives the right channel output CRO1.

Further, the reverberation time RVT is read out from the coefficient memory (P) 203 (see FIG. 17) and set in the register (M1) 213 similarly in step S1503.

The delay memory (E) 106 is accessed by the left channel address value set in the register (EA) 228 of step S1503 and waveform data written at the previous sampling timing is read out at the address of the delay memory (E) 106. The thus read waveform data is stored in the register (EI) 230 as the left channel waveform data in step S1504.

The right channel waveform data set in the register (M0) 212 in step S1503 and the reverberation time RVT set similarly set in the register (M1) 213 are multiplied with each other by the multiplier 216, and the multiplied result is stored in the register (MR) 221 in step S1504, whereby the processing equivalent to the function of the multiplier 535 in the comb filter 503 of FIG. 5 is realized.

Simultaneously, the output AO2 of the all-pass filter 502 (see FIG. 5) stored in the work memory (W) 204 is read out to the register (A1) 215 similarly in step S1504.

The left channel waveform data set in the register (EI) in step S1504 is stored in the work memory (W) 204 at its address 14 shown in FIG. 18 as a left channel output CLO1 of the comb filter 503 at step S1505, thereby realizing the processing equivalent to the processing in which the delay element 534 in the comb filter 503 of FIG. 5 derives the left channel output CLO1.

The adder and subtracter 217 adds the multiplied result obtained in the register (MR) 221 in step S1504 and the output AO2 of the all-pass filter 502 and which is stored in the register (A1) 215 in step S1504 and supplies the added result to the register (AR) 222 in step S1505. Then, the value from the register (AR) 222 is stored in the output register (SR) 224 in step S1506, whereby the processing equivalent to the function of the adder 536 in the comb filter 503 of FIG. 5 is realized.

Subsequently, the adder 227 adds the write address offset CW1 of the comb filter 503 read out from the address offset memory (T) 205 to the sampling count value SC and sets the added result in the register (EA) 228. Also, the aforementioned added result stored in the register (SR) 224 is stored in the register (EO) 229 in step S1507.

The value set in the above register (EO) 229 is stored in the delay memory (E) 106 by using the value stored in the above register (EA) 228 as the address in step S1508, thereby realizing the processing equivalent to the function in which the output of the adder 536 in the comb filter 503 of FIG. 5 is stored in the delay element 534.

Figure 15:
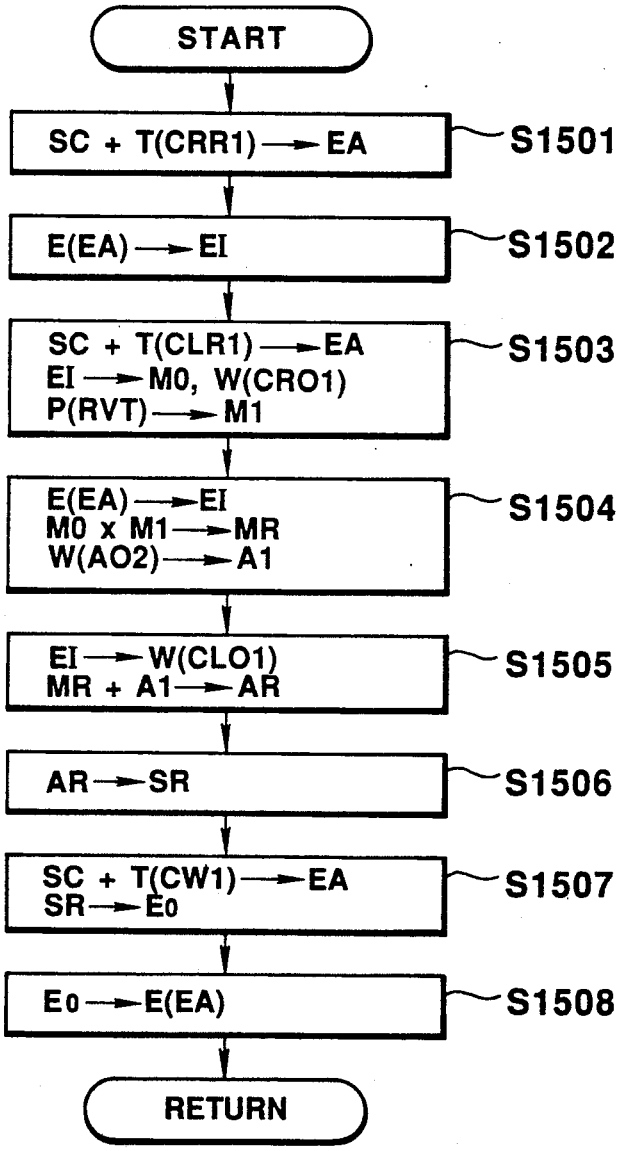
FIG. 15 is a flowchart to which references will be made in explaining operation processing that the DPS executes to realize the function of a comb filter in the reverberation effect adding unit of the present invention.

As set out above, the DSP 105 of FIGS. 1 or 2 repeatedly executes the processing program shown in the operation flowchart of FIG. 15 at every sampling timing to thereby realize the function of the comb filter 503 of FIG. 5.

In order to realize the functions of other comb filters 504 to 510 shown in FIG. 5, the DSP 105 must process the output AO2 of the all-pass filter 502 in accordance with a processing program similar to the operation flowchart of FIG. 15, whereby right channel outputs CRO2 to CRO8 of the respective comb filters and left channel outputs CLO2 to CLO8 of the respective comb filters are obtained in the work memory (W) 204 (see FIG. 18).

Figure 16:
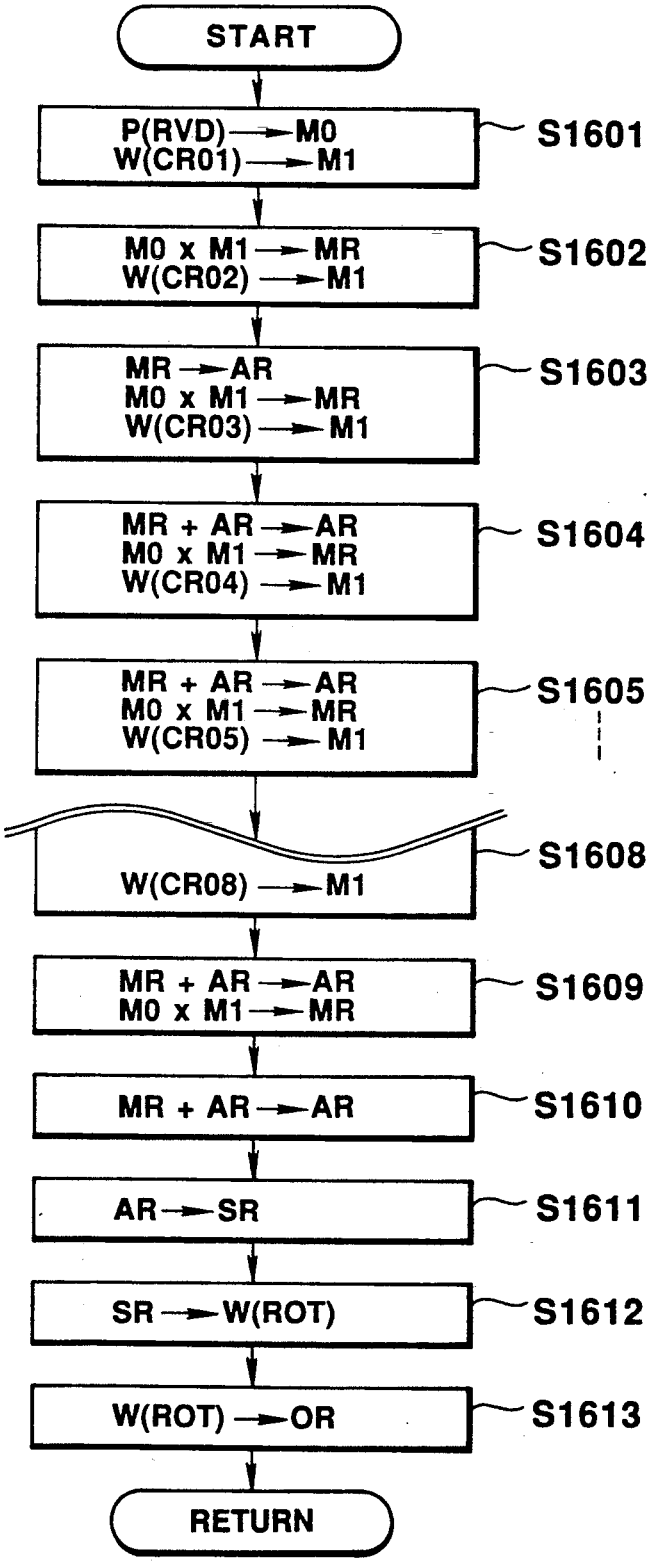
FIG. 16 is a flowchart to which references will be made in explaining operation processing that the DPS executes to realize the right channel accumulating operation in the reverberation effect adding unit.

Finally, FIG. 16 is a flowchart of a processing operation which is executed by the DSP 105 of FIGS. 1 or 2 in order to realize the functions of the multipliers 511 to 518 and the accumulating function of the accumulator 527.

As shown in FIG. 16, the reverberation depth RVD corresponding to the weighting coefficient multiplied with each of the channel outputs of the respective comb filters is read out from the coefficient memory (P) 203 and set in the register (M0 212. Also, the right channel output CRO1 of the comb filter 503 obtained on the basis of the operation flowchart of FIG. 15 is read out from the work memory (W) 204 and set in the register (M1) 213 in step S1601.

The multiplier 216 multiplies the reverberation depth RVD set in the register (M0) 212 and the right channel output CRO1 of the comb filter 503 set in the register (M1) 213 with each other and sets the multiplied result in the register (MR) 221 in step S1602, thereby realizing the processing equivalent to the function of the multiplier 511 of FIG. 5.

The right channel output CRO2 of the comb filter 504 is read out from the work memory (W) 204 to the register (M1) 213, similarly at step S1602.

After the content of the register (MR) 221 is transferred to the register (AR) 222, the reverberation depth RVD set in the register (M0) 212 is multiplied with the right channel output CRO2 of the comb filter 504 set in the register (M1) 213 and the multiplied result is supplied to the register (MR) 221 in step S1603, whereby the processing equivalent to the function of the multiplier 512 of FIG. 5 is realized.

The right channel outputs CRO3 to CRO8 of the respective comb filters 505 to 510 of FIG. 5 are similarly multiplied with the reverberation depth RVD. Then, the respective multiplied results from the register (MR) 221 are sequentially added to the accumulated values of the register (AR) 222 by the adder and subtracter 217 and then fed to the register (AR) 222 as new values (in steps S1604 to S1610). Therefore, it is possible to realize the processing equivalent to the functions of the multipliers 513 to 518 and the function of the accumulator 527 of FIG. 5.

When the right channel outputs CRO1 to CRO8 of the comb filters 503 to 510 are respectively weighted by the reverberation depth RVD and the accumulated result thereof is supplied to the register (AR) 222, then the content of the register (AR) 222 is transferred to the output register (SR) 224 in step S1611, and the content of the register (SR) 224 is stored in the work memory (W) 204 at its address ID of FIG. 18 as the reverberation right channel output ROT in step S1612.

This reverberation right channel output ROT is set in the signal output register (OR) 225 and is thereby delivered as the reverberation right channel output ROT from the reverberation effect adding unit 308 of FIG. 3 in step S1613.

As described above, the DSP 105 of FIGS. 1 or 2 repeatedly executes the processing program shown in the operation flowchart of FIG. 16 at every sampling timing, thereby realizing the accumulating function of the multipliers 511 to 518 and the accumulator 527 of FIG. 5.

In order to realize the accumulating function of the multipliers 519 to 526 and the accumulator 528 of FIG. 5, the DSP 105 must process the left channel outputs CLO1 to CLO8 of the comb filters 503 to 510 in accordance with a processing program similar to the operation flowchart of FIG. 16. Thus, the reverberation left channel output LOT is supplied to the work memory (W) at its address 1E shown in FIG. 18, and this reverberation left channel output LOT is set in the signal output register (OR) 225, thereby delivered as the reverberation left channel output LOT from the reverberation effect adding unit 308 of FIG. 3.

As described above, the DSP 105 of FIGS. 1 or 2 repeatedly executes the processing program shown in the operation flowchart of FIGS. 14 to 16 at every sampling timing, thereby the function of the reverberation effect adding unit 308 of FIGS. 3 or 5 is realized.

Let us finally describe the operation executed by the DSP 105 of FIGS. 1 or 2 in order to realize the functions of the adders 309 and 310 of FIG. 3.

In the DSP 105 shown in FIG. 2, as earlier noted, the right channel direct sound R supplied from the sound source 104 to the work memory (W) 204 within the DSP 105 is read out to the register (A0) 214 and the reverberation right channel output ROT similarly supplied to the work memory (W) 204 by the processing of the flowchart of FIG. 16 is read out to the register (A1) 215. The contents of the two registers (A0) 214 and (A1) 215 are added by the adder and subtracter 217, and the added result is stored in the address 1F of the work memory (W) 204 as the right channel musical sound output ROUT through the register (AR) 222 and the register (SR) 224. Then, the added result stored in the address 1F of the work memory (W) 204 is transferred to the output register (OR) 225 and supplied from the output register (OR) 225 to the D/A converter 107 of FIG. 1, whereby the processing equivalent to the function of the adder 309 of FIG. 3 is realized.

With respect to the left channel, the left channel direct sound L from the sound source 104 and the reverberation left channel output LOT stored in the work memory (W) 204 are added by the adder 217. The added result from the adder 217 is stored in the address 20 of the work memory (W) 204 as the left channel musical sound output LOUT, transferred to the output register (OR) 225 and is supplied from the output register (OR) 225 to the D/A converter 107 of FIG. 1, whereby the processing equivalent to the function of the adder 310 of FIG. 3 is realized.

In the above-mentioned embodiments, the value of the vibrato depth coefficient FMD used to control the changing width of the depth of the vibrato effect and the value of the LFO rate corresponding value RAT used to control the changing width of the speed of the vibrato effect are automatically varied in response to the kind of chord detected on the basis of the key note of the musical performance information then determined. That is, the present invention is constructed such that the depth and speed of the vibrato effect are varied in a ganged relation with the key pushing operation of the chord sound by the keyboard. Alternatively, the present invention may be constructed such that the value of the vibrato depth coefficient FMD and the value of the LFO rate corresponding value RAT are changed in response to the stepped amount of the pedal similarly to the case of the reverberation effect. Operation of another embodiment in which the present invention is constructed as in the latter case will now be described.

The arrangements of a first other embodiment are exactly the same as those of FIGS. 1 to 5 in the foregoing embodiments. In the specific operation of the processings described with reference to the operation flowcharts of FIGS. 6 to 8, the processings of steps S604, S605 and S606 shown by the broken line block step S600 of the timer 1 processing of FIG. 6 are not executed, and the timer 3 processing of FIG. 8 is replaced with a timer 3 processing of FIG. 20. Operation of this portion will be described hereinafter, and arrangements and operation of the same portion as those of the foregoing embodiments will not be described.

Figure 20:
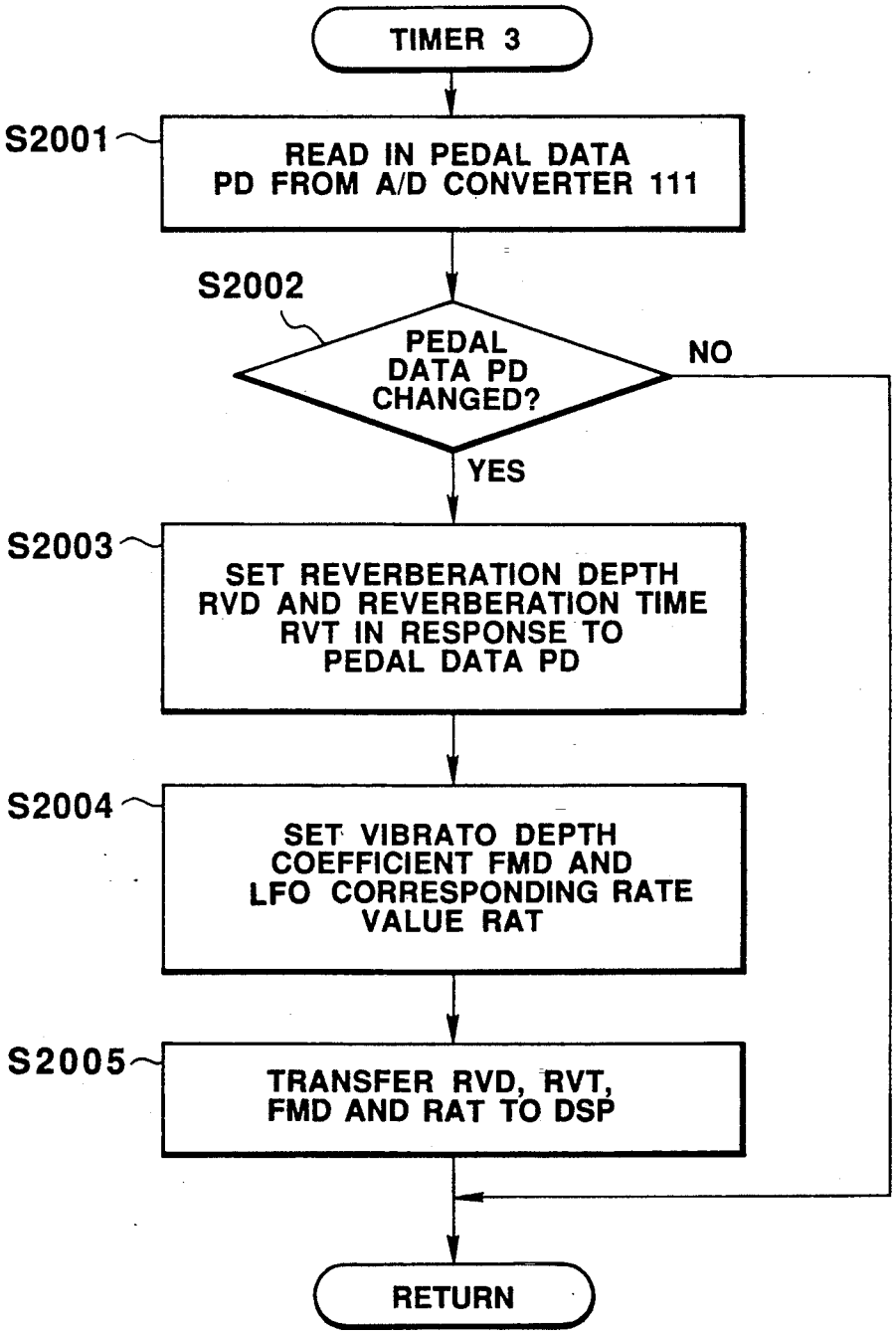
FIG. 20 is a flowchart to which references will be made in explaining operation of other embodiment of the timer 3 processing done by the CPU according to the present invention.

In the timer 3 processing in the further embodiment shown in FIG. 20, the processings from step S2001 to step S2003 are the same as those of step S801 to step S803 in the timer 3 processing of the embodiment shown in FIG. 8.

At step S2003 of FIG. 20, as earlier described in the foregoing embodiments, the reverberation table in the ROM 102 is accessed in response to the changed value of the pedal data PD, whereby the corresponding reverberation depth RVD and reverberation time RVT are read out from the reverberation table and set in the RAM 103.

A vibrato table, which is not shown on the ROM 102, is similarly accessed in response to the changed value of the pedal data PD, whereby the corresponding vibrato depth coefficient FMD and LFO rate corresponding value RAT are read out and set in the RAM 103 in step S2004. This vibrato table is similar to the reverberation table shown in FIG. 10 and is constructed such that the vibrato depth coefficient FMD corresponds with the reverberation depth RVD of FIG. 10 and the LFO rate corresponding value RAT corresponds with the reverberation time RVT of FIG. 10.

Then, the reverberation depth RVD, the reverberation time RVT, the vibrato depth coefficient FMD and the LFO rate corresponding value RAT thus obtained in steps S2003 and S2004 are transferred to the coefficient memory (P) 203 within the DSP 105 in step S2005.

The reverberation depth RVD and the reverberation time RVT are supplied to the comb filters 503 to 510 and the multipliers 511 to 526 as earlier noted with reference to FIG. 5 and these values are changed by the pedal stepped amount on the basis of the table characteristics shown in FIG. 10, whereby different reverberation sounds can be obtained. That is, if the stepped amount of the pedal 110 is larger, the reverberation effect becomes powerful and the reverberation time is extended similarly as described in the foregoing embodiments.

The vibrato depth coefficient FMD and the LFO rate corresponding value RAT are supplied to the multiplier 414 of the vibrato address calculating unit 406 and the adder 408 of the triangular wave generator unit 404 as already shown in FIG. 4. When the vibrato depth coefficient FMD and the LFO rate corresponding value RAT are changed by the pedal stepped amount on the basis of table characteristics determined by a vibrato table similar to the above-mentioned reverberation table of FIG. 10, different vibrato effects can be obtained. That is, if the stepped amount of the pedal 110 is larger, then the vibrato effect becomes powerful and the vibrato time is extended. In this case, the vibrato effect may be controlled by the right pedal and the reverberation effect may be controlled by the left pedal or vice versa.

As described above, according to the above further embodiment of the present invention, the control of the vibrato effect can be realized by the information of the stepped amount of the pedal 110.

Incidentally, operations of the DSP 105 of FIGS. 1, 2 and 3 in this embodiment are exactly the same as those described with reference to the operation flowcharts of FIGS. 11 to 16.

Having described the preferred embodiments of the invention with reference to the accompanying drawings, it is to be understood that the invention is not limited to those precise embodiments and that various changes and modifications thereof could be effected by one skilled in the art without departing from the spirit or scope of the invention as defined in the appended claims.

What is claimed is:

1. An electronic musical instrument having a reverberation effect adding device comprising:

sound source means for generating a musical sound signal in response to a musical performance information;

modulating means for modulating either a frequency or phase of an original musical sound signal generated from said sound source means;

reverberation sound generating means for adding a reverberation effect to the musical sound signal modulated by said modulating means to generate a reverberation sound;

operating means for generating an operation information for controlling a sound volume of said reverberation sound in response to an operation performed by a player;

reverberation sound volume control means for controlling a sound volume of the reverberation sound generated by said reverberation sound generating means in accordance with the operation information generated by said operating means; and adding means for adding the reverberation sound generated by said reverberation sound generating means to an original musical sound signal generated from said sound source means to generate a musical sound output signal having a reverberation effect.

2. An electronic musical instrument according to claim 1, further comprising reverberation time control means for controlling a reverberation time of the reverberation sound generated from said reverberation sound generating means in accordance with said operation information from said operating means.

3. An electronic musical instrument according to claim 1, further comprising modulation characteristic control means for controlling a modulation characteristic of said musical sound signal modulated by said modulating means in accordance with said operation information from said operating means.

4. An electronic musical instrument according to claim 2, further comprising modulation characteristic control means for controlling a modulation characteristic of said musical sound signal modulated by said modulating means in accordance with said operation information from said operating means.

5. An electronic musical instrument according to claim 1, further comprising modulation characteristic control means for controlling a modulation characteristic of said musical sound signal modulated by said modulating means in accordance with said musical performance information.

6. An electronic musical instrument according to claim 2, further comprising modulation characteristic control means for controlling a modulation characteristic of said musical sound signal modulated by said modulating means in accordance with said musical performance information.

7. An electronic musical instrument according to claim 5, wherein said musical performance information used by said modulation characteristic control means to control said modulation characteristic comprises information indicative of a kind of chord played.

8. An electronic musical instrument according to claim 6, wherein said musical performance information used by said modulation characteristic control means to control said modulation characteristic comprises information indicative of a kind of chord played.

9. An electronic musical instrument according to claim 1, wherein said operating means comprises a pedal operating means.

10. An electronic musical instrument according to claim 1, further comprising a keyboard for generating said musical performance information.

11. An electronic musical instrument having a reverberation effect adding device, comprising:

sound source means for generating a musical sound signal in response to a musical performance information;

weighting means for weighting an original musical sound signal generated from said sound source means in response to said musical performance information;

reverberation sound generating means for adding a reverberation effect to the musical sound signal modulated by said weighting means to generate a reverberation sound;

operating means for generating an operation information for controlling a sound volume of said reverberation sound on the basis of operation done by a player;

reverberation sound volume control means for controlling a sound volume of the reverberation sound generated by said reverberation sound generating means in accordance with the operation information from said operating means; and adding means for adding the reverberation sound generated from said reverberation sound generating means to the original musical sound generated from said sound source means to generate a musical sound output signal.

12. An electronic musical instrument according to claim 11, wherein said musical performance information to which said weighting means is responsive, comprises a key note.

13. An electronic musical instrument according to claim 11, further comprising reverberation time control means for controlling a reverberation time of said reverberation sound generated by said reverberation sound generating means in accordance with the operation information from said operation means.

14. An electronic musical instrument according to claim 12, further comprising reverberation time control means for controlling a reverberation time of said reverberation sound generated by said reverberation sound generating means in accordance with the operation information from said operation means.

15. An electronic musical instrument according to claim 11, wherein said operating means comprises a pedal operating means.

16. An electronic musical instrument according to claim 11, further comprising a keyboard for generating said musical performance information.

* * * * *

UNITED STATES PATENT AND TRADEMARK OFFICE

CERTIFICATE OF CORRECTION

PATENT NO. : 5,166,464

DATED : November 24, 1992

INVENTOR(S) : SAKATA et al

It is certified that error appears in the above-identified patent and that said Letters Patent is hereby corrected as shown below:

TITLE PAGE:

Section [54], left column (title), line 2 -

After "REVERBERATION", insert --EFFECT--.

Signed and Sealed this

Twenty-first Day of December, 1993

*Attest:*

Bruce Lehman

BRUCE LEHMAN

*Attesting Officer*

*Commissioner of Patents and Trademarks*